US009870661B2

(12) United States Patent
Arora et al.

(10) Patent No.: US 9,870,661 B2
(45) Date of Patent: Jan. 16, 2018

(54) ACCESS CONTROL SYSTEM

(71) Applicant: AT&T Intellectual Property I, L.P., Atlanta, GA (US)

(72) Inventors: Aditya Arora, Johns Creek, GA (US); Timothy Barge, Buford, GA (US); Trinh Adams, Suwanee, GA (US); Tim Johnson, Ball Ground, GA (US); Mark Antley, Sharpsburg, GA (US)

(73) Assignee: AT&T INTELLECTUAL PROPERTY I, L.P., Atlanta, GA (US)

( * ) Notice: Subject to any disclaimer, the term of this patent is extended or adjusted under 35 U.S.C. 154(b) by 217 days.

(21) Appl. No.: 14/262,718

(22) Filed: Apr. 26, 2014

(65) Prior Publication Data

US 2015/0310682 A1 Oct. 29, 2015

(51) Int. Cl.
*G07C 9/00* (2006.01)

(52) U.S. Cl.
CPC ..... *G07C 9/00166* (2013.01); *G07C 9/00158* (2013.01)

(58) Field of Classification Search
CPC ..... G07C 9/00126
USPC ..... 340/5.7
See application file for complete search history.

(56) References Cited

U.S. PATENT DOCUMENTS 5,939,694 A 8/1999 Holcomb et al.
7,246,744 B2 * 7/2007 O'Brien ..... G07C 9/00103 235/382
7,401,732 B2 * 7/2008 Haddad ..... G07C 9/00007 235/380
7,493,496 B2 2/2009 Smith et al.
7,988,627 B2 8/2011 Bagan
8,207,816 B2 6/2012 Crigger et al.
2001/0011680 A1 8/2001 Soltesz et al.
2008/0255901 A1 10/2008 Carroll et al.
2009/0138563 A1 * 5/2009 Zhu ..... H04W 4/14 709/206
2009/0153335 A1 * 6/2009 Birtcher ..... G06Q 10/10 340/573.1
2011/0130635 A1 6/2011 Ross
2011/0211584 A1 * 9/2011 Mahmoud ..... H04L 12/2834 370/401
2012/0228377 A1 9/2012 Carpenter et al.
2012/0293642 A1 11/2012 Berini et al.
2013/0027187 A1 1/2013 Yepez
2013/0215275 A1 8/2013 Berini et al.
2013/0292467 A1 11/2013 Avs et al.
2015/0213503 A1 * 7/2015 Friborg, Jr. ..... H04L 51/14 705/14.64
2016/0014605 A1 * 1/2016 Robinton ..... G06F 21/32 726/6

FOREIGN PATENT DOCUMENTS

EP 1041506 4/2000

* cited by examiner

*Primary Examiner* — Joseph Feild
*Assistant Examiner* — John Mortell
(74) *Attorney, Agent, or Firm* — Scott P. Zimmerman, PLLC

(57) ABSTRACT

An access control system provides authentication and notification. A visitor to a facility, for example, authenticates to the access control system. Once an identity of the visitor is confirmed, the access control system sends a notification to a host, such as an employee. The notification informs the host of the arrival of the visitor.

17 Claims, 28 Drawing Sheets

ACCESS CONTROL SYSTEM

COPYRIGHT NOTIFICATION

A portion of the disclosure of this patent document and its attachments contain material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

BACKGROUND

Controlled access is vital to many operations. Many buildings and plants require secure access to ensure only authorized personnel are admitted. Many stores and homes also have controlled access to limit security concerns. Conventional access systems, though, are cumbersome in today's electronic environment.

BRIEF DESCRIPTION OF THE SEVERAL VIEWS OF THE DRAWINGS

The features, aspects, and advantages of the exemplary embodiments are understood when the following Detailed Description is read with reference to the accompanying drawings, wherein:

FIG. 3 is a schematic illustrating detection of conditions, according to exemplary embodiments;

DETAILED DESCRIPTION

The exemplary embodiments will now be described more fully hereinafter with reference to the accompanying drawings. The exemplary embodiments may, however, be embodied in many different forms and should not be construed as limited to the embodiments set forth herein. These embodiments are provided so that this disclosure will be thorough and complete and will fully convey the exemplary embodiments to those of ordinary skill in the art. Moreover, all statements herein reciting embodiments, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or processes illustrating the exemplary embodiments. The functions of the various elements shown in the figures may be provided through the use of dedicated hardware as well as hardware capable of executing associated software. Those of ordinary skill in the art further understand that the exemplary hardware, software, processes, methods, and/or operating systems described herein are for illustrative purposes and, thus, are not intended to be limited to any particular named manufacturer.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

It will also be understood that, although the terms first, second, etc. may be used herein to describe various elements, these elements should not be limited by these terms. These terms are only used to distinguish one element from another. For example, a first device could be termed a second device, and, similarly, a second device could be termed a first device without departing from the teachings of the disclosure.

Figure 1:
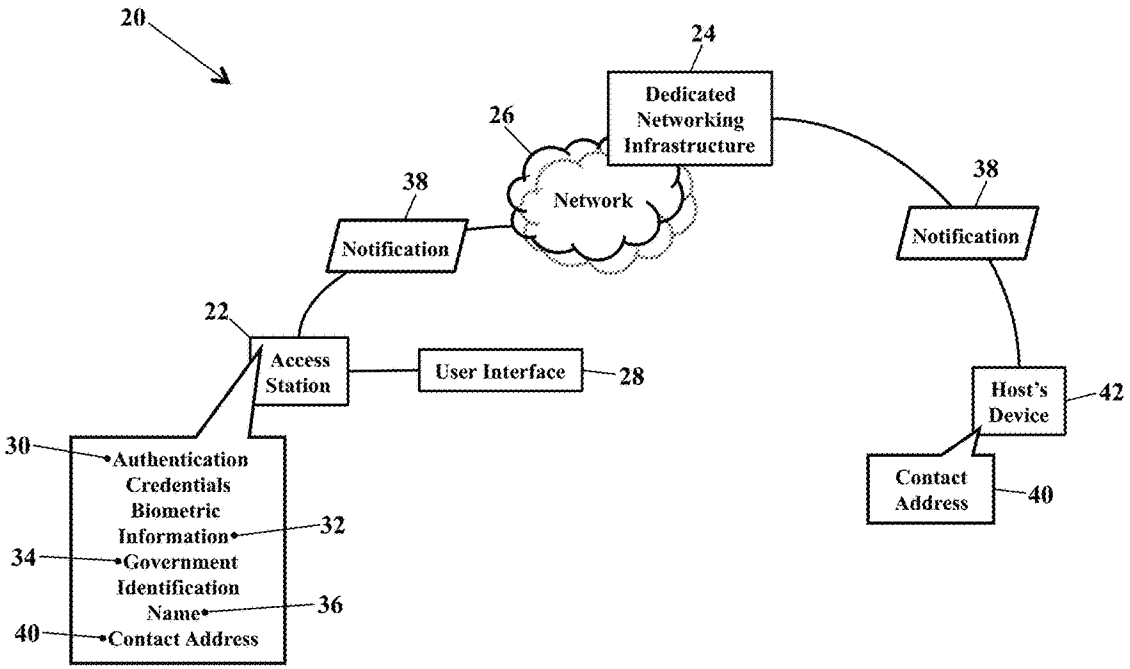
FIG. 1 is a simplified schematic illustrating an environment in which exemplary embodiments may be implemented.

FIG. 1 is a simplified schematic illustrating an environment in which exemplary embodiments may be implemented. FIG. 1 illustrates an access control system 20 that provides visitors at least temporary access to a secure facility, such as an office, building, or home. The access control system 20 includes an access station 22 that communications with dedicated networking infrastructure 24 using a communications network 26. For example, when a user wishes access, the user registers with the access station 22. The access station 22 may be placed or located within a lobby or entrance area of any building or facility. The access station 22 has a user interface 28 that allows a human user to enter authentication credentials 30. A visitor or employee, for example, may be required to enter a name, code, telephone number, or any other unique identifier. Indeed, the user may enter or submit her biometric information 32 and/or any government identification 34 (such as a state driver's license). If the authentication credentials 30 are verified or confirmed, then access may be granted.

Perhaps a common scenario helps explain the access station 22. Even though employees may register, the access station 22 is perhaps better understood with reference to visiting users. Suppose a visitor enters the lobby of a building and wishes to contact an employee (or "host"). The visitor inputs a name 36 of the host, and the access control system 20 notifies the host. That is, the access station 22 causes a notification 38 to be sent to a contact address 40 associated with the host's device 42. The access control system 20 may then permit the visitor to enter the building, or the host may be required to escort the visitor, as later paragraphs will explain.

Figure 2:
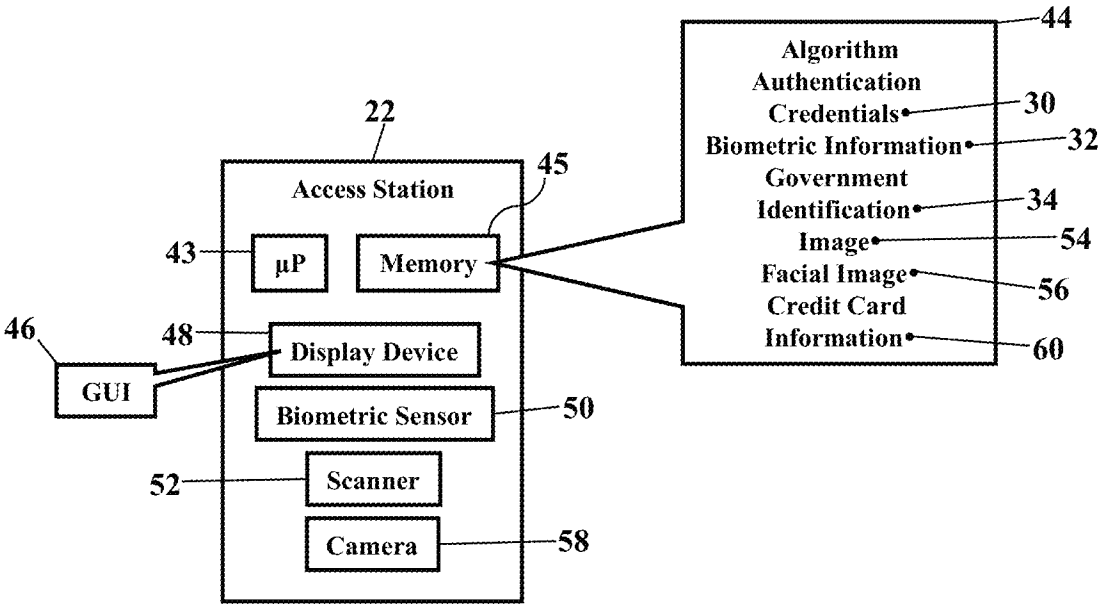
FIGS. 2-3 are more detailed illustrations of an access station, according to exemplary embodiments.
Figure 3:
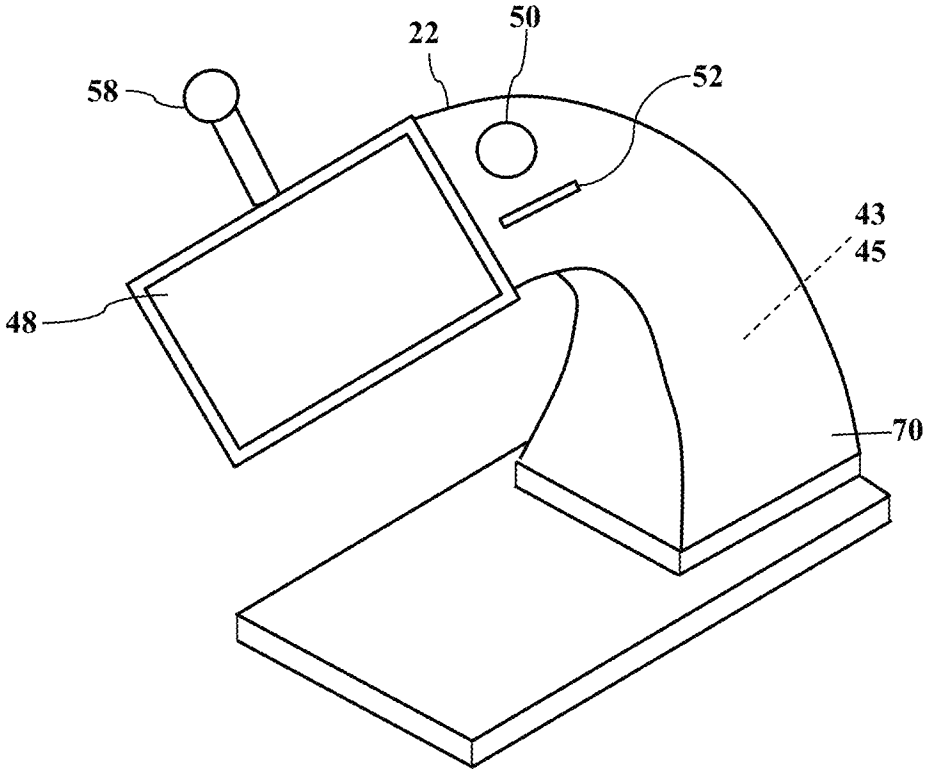

FIGS. 2-3 are more detailed illustrations of the access station 22, according to exemplary embodiments. FIG. 2 is a more detailed block diagram of the access station 22, while FIG. 3 illustrates a conceptual rendering of the access station 22 as a kiosk 70. As FIG. 2 illustrates, the access station 22 may have a processor 43 (e.g., "μP"), application specific integrated circuit (ASIC), or other component that executes an algorithm 44 stored in a local memory 45. The algorithm 44 has instructions, code, and/or programs that may cause the processor 43 to generate a graphical user interface 46 on a display device 48. The algorithm 44 instructs the processor 43 to produce visual prompts on the display device 48, and the visiting user enters her responses. The display device 48, for example, may include a capacitive layer, thus allowing the user to submit touch inputs using the display device 48. A keyboard, of course, may also permit inputs to the access station 22. The algorithm 44 may also cause the processor 43 to produce audible prompts from a speaker or other audible device (not shown for simplicity). The visiting user submits her authentication credentials 30 for access.

The authentication credentials 30 may include the biometric information 32. The access station 22 may include a biometric sensor 50 that receives the biometric information 32. The biometric information 32, for example, may describe a fingerprint or retinal scan, although any physical or demographic information may be submitted. The biometric information 32 and the biometric sensor 50 are known and need not be described in detail.

Exemplary embodiments may require the government identification 34. When the user submits her authentication credentials 30, the user may be required to submit a driver's license or other government identification 34. The user, for example, may submit her driver's license to a digital scanner 52 that captures a digital image 54 of the visitor's driver's license or other government identification 34. Information obtained from the digital image 54 may be paired with the biometric information 32 to reduce fraudulent registrations. The user's driver's license, in other words, helps prevent a nefarious visitor from entering bogus information that does not match a finger print scan.

The authentication credentials 30 may further include a digital facial image 56 of the visiting user. The access station 22 may include a digital camera 58 that captures the facial image 56 of the of the visitor's face or torso.

The authentication credentials 30 may further include credit card information 60. As the user interacts with the access station 22, she may be prompted to submit a credit card number. The user may insert her credit card into a magnetic reader, or the digital scanner 52 may capture the digital image 54 of her credit card number.

Exemplary embodiments may utilize any processing component, configuration, or system. The processor 43 could be multiple processors, which could include distributed processors or parallel processors in a single machine or multiple machines. The processor 43 can be used in supporting a virtual processing environment. The processor 43 could include a state machine, application specific integrated circuit (ASIC), programmable gate array (PGA) including a Field PGA, or state machine. When any of the processors execute instructions to perform "operations", this could include the processor 43 performing the operations directly and/or facilitating, directing, or cooperating with another device or component to perform the operations. Indeed, exemplary embodiments may be embodied in any processor-controlled device, as later paragraphs will explain.

FIG. 3 illustrates the kiosk 70. While the access station 22 may have any design and configuration, FIG. 3 illustrates a conceptual rendition for tabletop use. That is, the kiosk 70 may be placed on a counter or tabletop for ease of use and access. The kiosk 70 may have a sleek outer shell or casing that houses its internal componentry (such as the processor 43 and memory 45). The display device 48 is integrated into the kiosk 70, thus further enhancing an all-in-one design characteristic. The kiosk 70 may further integrate the biometric sensor 50 and the digital scanner 52 for ease of access and use. While the camera 58 may also be integrated, the camera 58 preferably has an adjustable mount to accommodate different heights of users.

Figure 4:
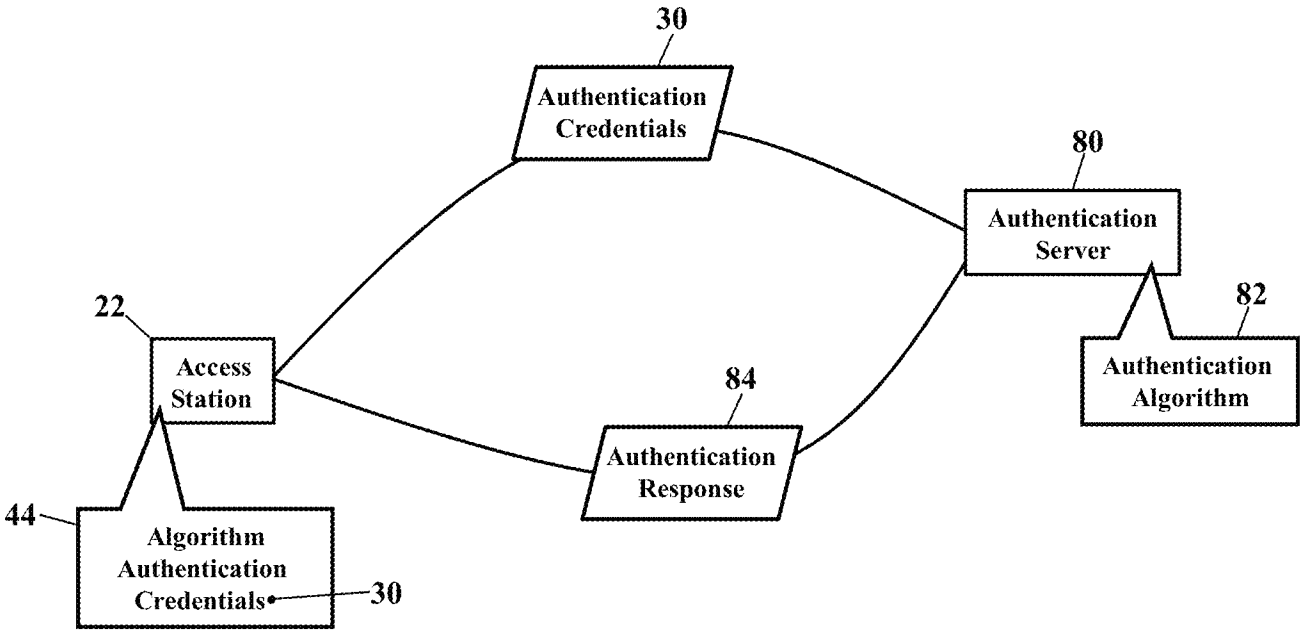
FIG. 4 is a schematic illustrating an authentication server, according to exemplary embodiments.

FIG. 4 is a schematic illustrating an authentication server 80, according to exemplary embodiments. Once the visiting user submits her authentication credentials 30, the access station 22 authenticates the visitor. The algorithm 44, for example, may include any code or programming that authenticates the visiting user (using the authentication credentials 30). Authentication, however, may be complicated, and many special algorithms from many vendors are available. In practice, then, exemplary embodiments may outsource authentication to the authentication server 80. The authentication server 80 may specialize in authentication processes. The access station 22, then, may simply send the authentication credentials 30 into the communications network (illustrated as reference numeral 26 in FIG. 1) to a network address associated with the authentication server 80. The authentication server 80 has a processor (e.g., "μP") and memory (not shown for simplicity) that executes an authentication algorithm 82. The authentication algorithm 82 causes the authentication server 80 to authenticate the visitor's authentication credentials 30. Many authentication algorithms and processes are known, and the authentication server 80 may use any technique to approve or deny the visitor's authentication credentials 30. However the authentication is performed, the authentication algorithm 82 causes the authentication server 80 to return send an authentication response 84 to the network address associated with the access station 22.

Figure 5:
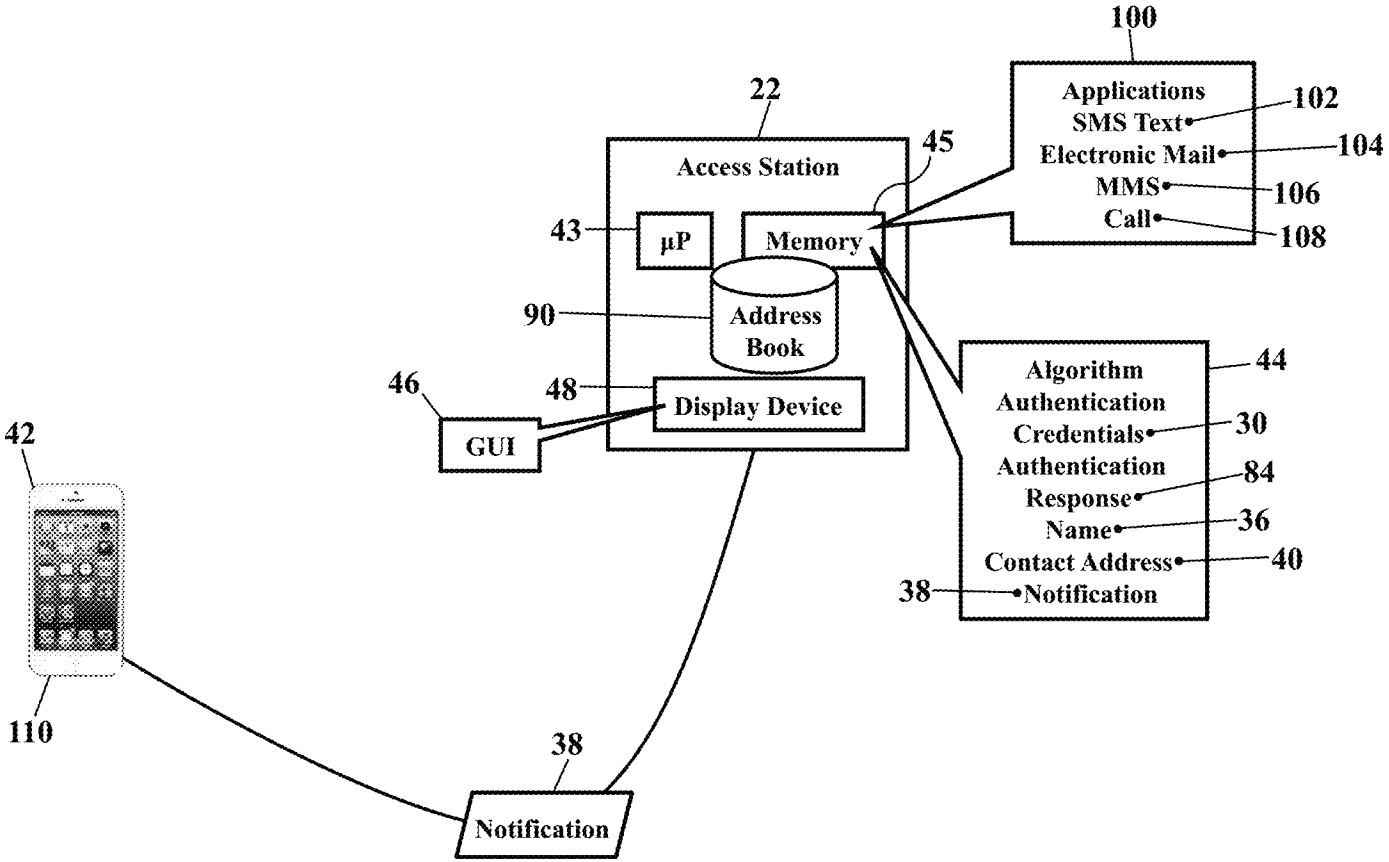
FIG. 5 is a schematic illustrating a notification system, according to exemplary embodiments.

FIG. 5 is a schematic illustrating a notification system, according to exemplary embodiments. Once the access station 22 receives the authentication response 84, the algorithm 44 causes the processor 43 to inspect the authentication response 84 for an approval or denial. If the visitor's authentication credentials 30 were denied, then the access station 22 may reject the visitor and deny access and entry. More likely, though, the visitor is permitted a second attempt at authentication. When the authentication credentials 30 are approved, the access station 22 prompts the user for the name 36 of the host. The display device 48, for example, displays the graphical user interface 46 that prompts for the name 36 of the employee the visitor wishes to contact. The visiting user may select from a listing of employee names, or the user may be required to input the letters of the host's name 36.

An address book 90 may then be consulted. Once the user enters the host's name 36, exemplary embodiments determine the contact address 40 associated with the host's name 36. The access station 22, for example, queries the address book 90 for the name 36 entered by the visiting user. The address book 90 is illustrated as being locally stored in the memory 45 of the access station 22, but the address book 90 may be remotely stored and accessed from any location in the communications network (illustrated as reference numeral 26 in FIG. 1). Regardless, the address book 90 may be a database that stores associations between different names and different contact addresses. Once the name 36 of the host is known, the access station 22 retrieves the corresponding contact address 40 associated with the name 36. The contact address 40 may be a device address, email address, domain name, telephone number, Internet Protocol address, or any other network or device identifier.

The notification 38 is then initiated. Once the access station 22 retrieves the host name's corresponding contact address 40, the algorithm 44 causes the processor 43 to initiate the notification 38 to the contact address 40. The processor 43, for example, may call or execute other software applications 100 to notify the contact address 40. For example, the processor 43 may call or execute a short messaging service ("SMS") application 102 to send a text message to the contact address 40. An electronic mail (or "email") application 104 may be used to send an email to the contact address 40. A multi-media messaging service ("MMS") application 106 may be used to send a multi-media message to the contact address 40. A call application 108 may be used to initial or establish a telephony call or voice-over IP call to the contact address 40. Whatever the notification process, the notification 38 may route to the contact address 40. FIG. 5, for example, illustrates the notification 38 routing to the employee host's device 42, which is illustrated as mobile smartphone 110. The notification 38, however, may route to any destination or device, such as a telephone, desktop computer, tablet computer, or other mobile device.

Figure 6:
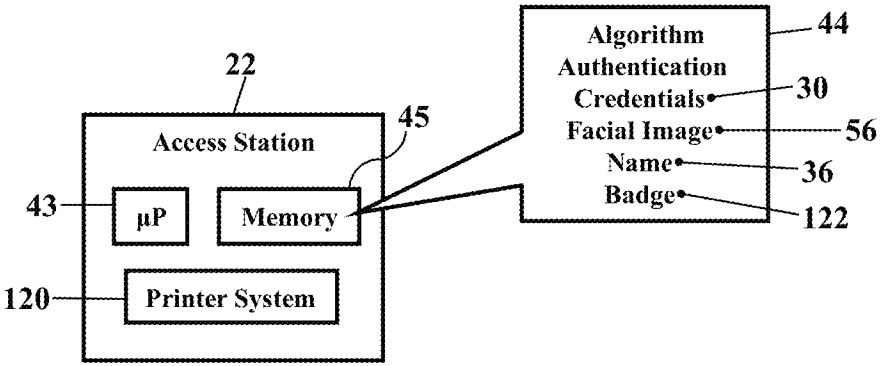
FIG. 6 is a schematic illustrating a printer system, according to exemplary embodiments.
Figure 7:
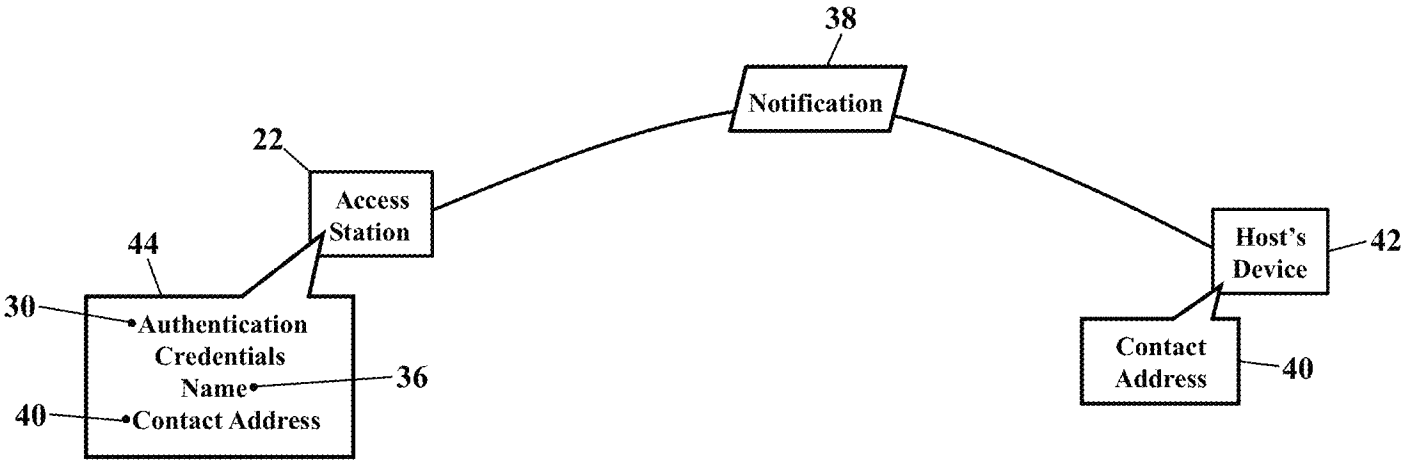
FIGS. 7-11 are schematics further illustrating the notification system, according to exemplary embodiments.

FIG. 6 is a schematic illustrating a printer system 120, according to exemplary embodiments. Once the visiting user is authenticated, and the host is notified, the access control system 20 may generate a physical badge 122. The access station 22 may cause the printer system 120 to output a print of the physical badge 122. The visiting user may thus be required to wear and to prominently display the physical badge 122 during her visit. The printer system 120 may be a standalone printer that interfaces with the access station 22, or the printer system 120 may be integrated into a housing of the kiosk (illustrated as reference numeral 70 in FIG. 3). The algorithm 44, for example, may instruct the processor 43 to retrieve the visiting user's facial image 56 for inclusion on the badge 122. The badge 122 may further include the name 36 of the employee host and the name of the visitor (perhaps obtained from the visitor's authentication credentials 30). Exemplary embodiments may print a label for insertion or adhesion to the badge 122. The visiting user may thus be required to wear and to prominently display the physical badge 122 during the visit.

Exemplary embodiments thus automate access procedures. Conventional access control often uses physical (paper) logs to register visitors, which is slow and causes long lines at guard stations. Exemplary embodiments, instead, electronically authenticate visitors, thus providing a much faster solution. Exemplary embodiments may electronically track each visitor, using timestamps and network transactions that log each visitor's interactions with the access station 22. Moreover, exemplary embodiments electronically notify host employees of their visitors, thus further speeding security procedures.

Exemplary embodiments may be applied regardless of networking environment. Exemplary embodiments may be easily adapted to cellular, WI-FI®, and/or BLUETOOTH® networks. Exemplary embodiments may be applied to any devices utilizing any portion of the electromagnetic spectrum and any signaling standard (such as the IEEE 802 family of standards, GSM/CDMA/TDMA or any cellular standard, and/or the ISM band). Exemplary embodiments, however, may be applied to any processor-controlled device operating in the radio-frequency domain and/or the Internet Protocol (IP) domain. Exemplary embodiments may be applied to any processor-controlled device utilizing a distributed computing network, such as the Internet (sometimes alternatively known as the "World Wide Web"), an intranet, a local-area network (LAN), and/or a wide-area network (WAN). Exemplary embodiments may be applied to any processor-controlled device utilizing power line technologies, in which signals are communicated via electrical wiring. Indeed, exemplary embodiments may be applied regardless of physical componentry, physical configuration, or communications standard(s).

FIGS. 7-11 are schematics further illustrating the notification system, according to exemplary embodiments. When the visitor is authenticated, the access station 22 initiates the notification 38 to the employee host's contact address 40. The notification 38 informs the host that the visitor is present and awaiting contact. Exemplary embodiments, then, may identify the visitor in the notification 38. For example, the notification 38 may include data or information that identifies the visitor's name 36, such as "Mary Smith has arrived and is waiting in the lobby." The visitor's name 36 may be obtained from the authentication credentials 30, or the visitor may be required to enter her name 36 when authenticating to the access station 22. The notification 38 may further identify the visitor's company or employer, perhaps also obtained from the authentication credentials 30 or manual entry during registration. If the visitor has previously registered with the access station 22, a visitor profile may be queried for textual information. The notification 38 may thus have any content that helps identify the visitor and her purpose.

Figure 8:
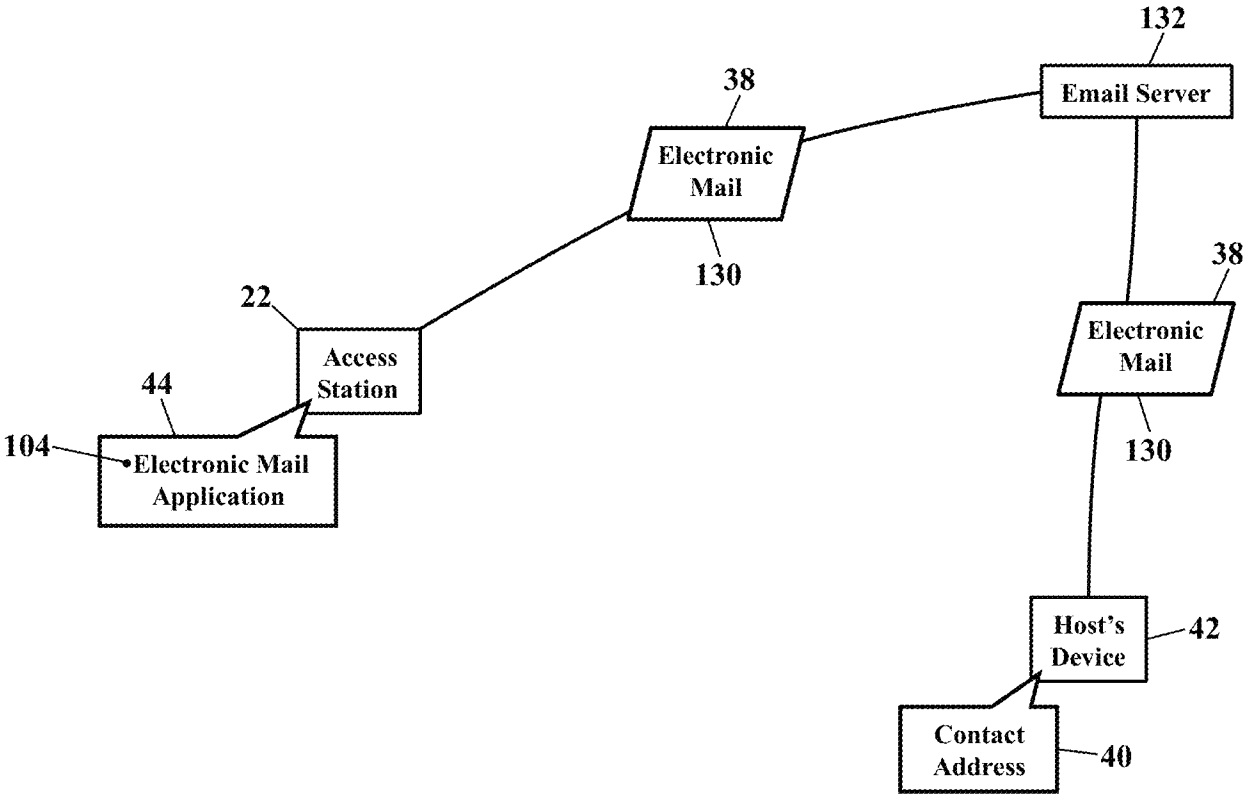

FIG. 8 illustrates an electronic mail message 130. Here the access station 22 sends the electronic mail message 130 to the contact address 40. The access station 22 may thus call, invoke, or execute the electronic mail application 104 for email capability. The access station 22 generates the electronic mail message 130 and sends the electronic mail message 130 to the contact address 40. The electronic mail message 130 routes to a network address associated with an email server 132 that stores emails associated with the contact address 40. When the host's device 42, for example, access the email server 132, the host's device 42 downloads the electronic mail message 130. The host's device 42 then processes and displays the informational content of the electronic mail message 130, thus informing the host of the visitor's arrival.

Figure 9:
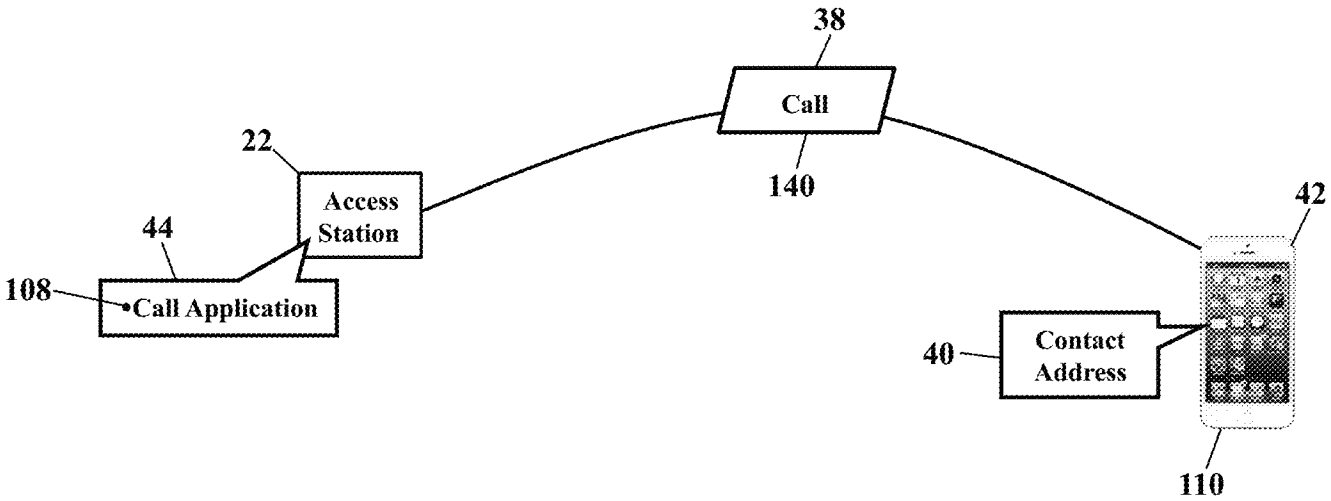

FIG. 9 illustrates a call 140 as the notification 38. Here the access station 22 initiates the call 140 to the contact address 40 to inform the host of the visitor. The access station 22 may thus call, invoke, or execute the call application 108 to establish a telephony call or a voice-over Internet call to the contact address 40. Telephony calls and voice-over Internet calls are both well known, so no detailed explanation is needed. FIG. 9, for simplicity, illustrates the call 140 routing to the host's smartphone 110. When the call 140 is answered or acknowledged, the access station 22 may cause an audible recording to be played, thus announcing the visitor's arrival.

Figure 10:
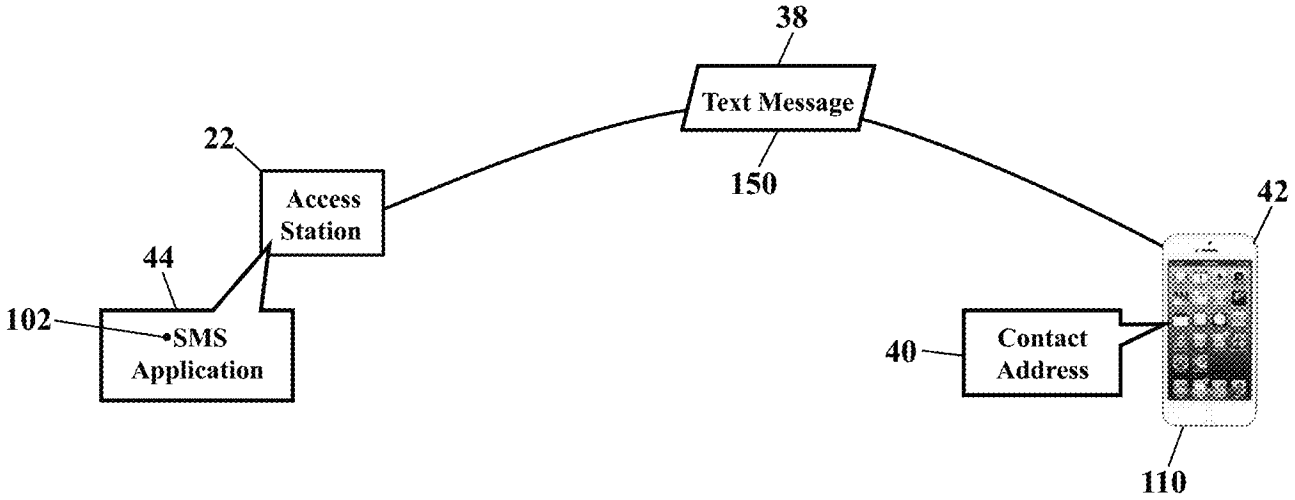

FIG. 10 illustrates text messaging notifications. Here the access station 22 sends a text message 150 to the contact address 40. The access station 22 may thus call, invoke, or execute the SMS application 102 to generate and/or to send the text message 150. The text message 150 routes to the contact address 40, such as the host's smartphone 110. The host's smartphone 110 then processes the text message 150, thus informing the host of the visitor's arrival.

Figure 11:
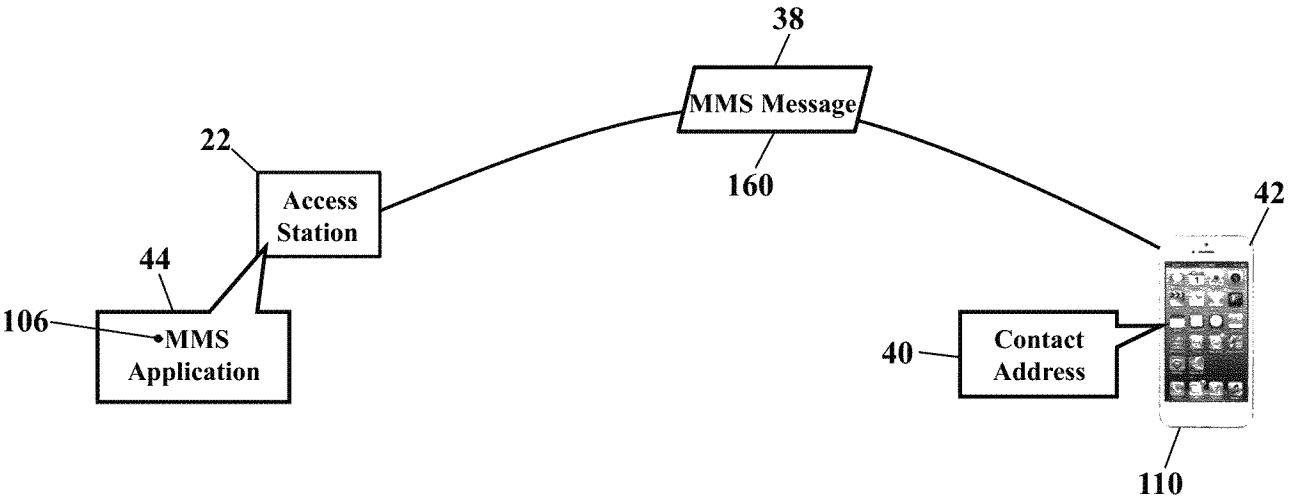

FIG. 11 illustrates multi-media messaging, according to exemplary embodiments. Here the access station 22 sends a multi-media system ("MMS") message 160 to the contact address 40. The access station 22 may thus call, invoke, or execute the MMS application 106 to generate and/or to send the multi-media message 160. The multi-media message 160 routes to the contact address 40, which is again illustrated as being associated with the host's smartphone 110. The multi-media message 160 also informs the host of the visitor's arrival.

Figure 12:
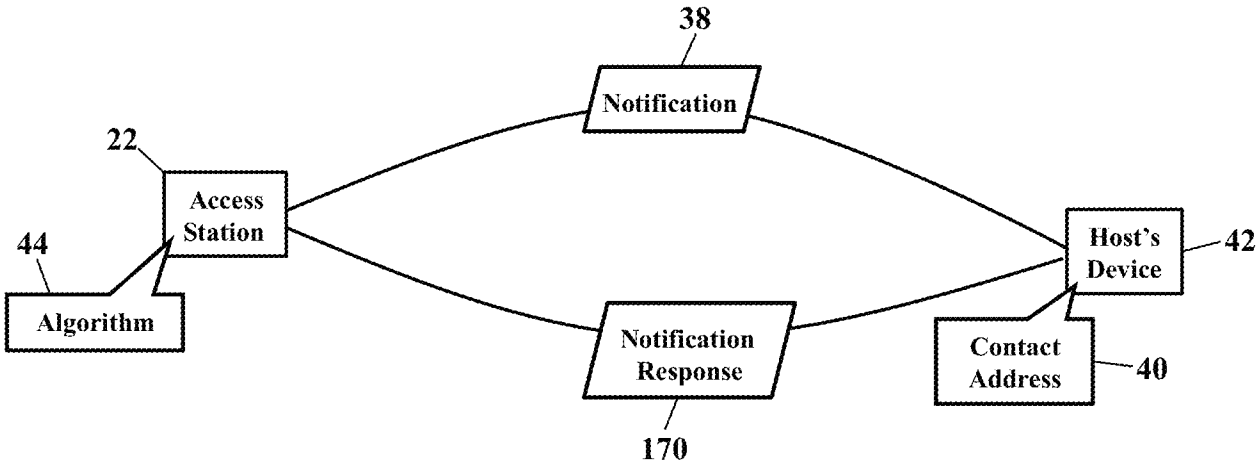
FIGS. 12-13 are schematics illustrating a notification response, according to exemplary embodiments.
Figure 13:
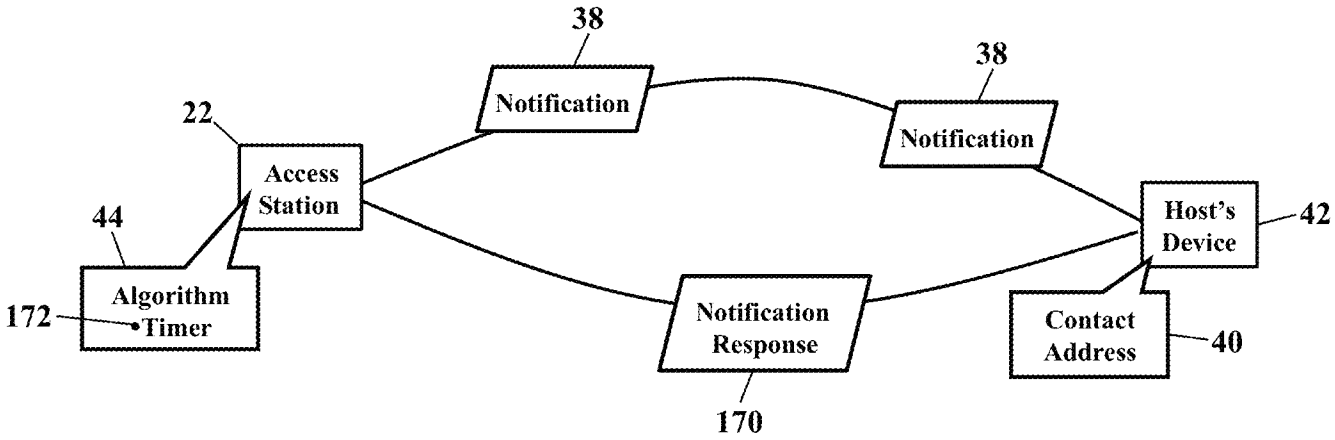

FIGS. 12-13 are schematics illustrating a notification response 170, according to exemplary embodiments. However the employee host is notified of the visitor's arrival, the access station 22 may receive the notification response 170 from the contact address 40. The host's smartphone 110, as an example, may acknowledge receipt of the notification 38. Indeed, the human host may even cause the smartphone 110 to send a reply message, such as a reply SMS or MMS message. The notification response 170 may route to the network address associated with the access station 22. When the access station 22 receives the notification response 170, the access station 22 thus knows that the contact address 40 successfully received the notification 38. That is, the host's smartphone 110 audibly and/or visually informed the host of the visitor's presence.

As FIG. 13 illustrates, the access station 22 may periodically remind the host. When the access station 22 receives the notification response 170, the access station 22 may wait a predetermined amount of time before sending reminder notifications to the host. As the reader may understand, even though the visitor may be authenticated, security policies may still prohibit visitors without an escort. That is, the employee host may be required to physically escort the visitor. The access station 22, then, may have programming that periodically reminds the employee host that physical escort is required.

A timer 172 may be initialized. The timer 172 has an initial value and counts up or down to a final value. When the access station 22 receives the notification response 170, the timer 172 may begin incrementing until expiration at the final value. The access station 22 may await arrival of the host as the timer 172 increments. The access station 22, for example, may monitor for registration of the employee host, such as by entry of the host's own credentials. If the host fails to login by the expiration of the timer 172, then the access station 22 may send another, perhaps duplicate, notification 38 to the host's contact address 40. The additional notifications 38 remind the host that the visitor is awaiting escort. However, once the host successfully authenticates to the access station 22, subsequent notifications 38 may cease. The badge 122 is printed, and the host escorts the visitor into the facility.

Figure 14:
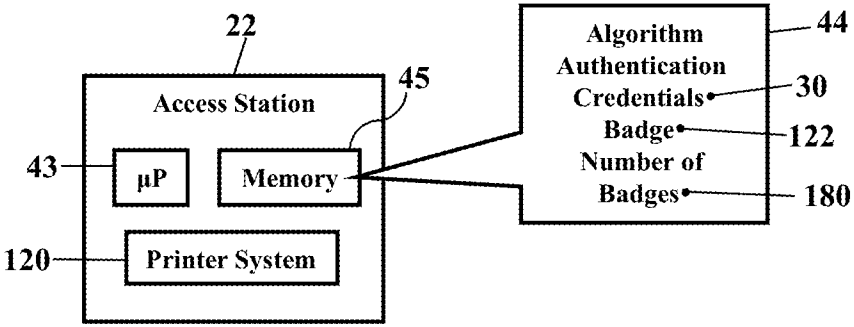
FIG. 14 is a schematic illustrating multiple visitors, according to exemplary embodiments.

FIG. 14 is a schematic illustrating multiple visitors, according to exemplary embodiments. As the reader may also understand, sometimes multiple visitors may arrive to contact a single employee host. A vendor, for example, may send multiple team members to consult with the host. Exemplary embodiments may thus streamline registration for the team members. For example, a single team member may authenticate to the access station 22, but multiple badges 122 may be printed. The single team member, once authenticated, may input the number 180 of badges that are required for her team. The single team member, in other words, may vouch for the identity of her other teammates. Exemplary embodiments, however, may require that each visiting team member individually authenticate, thus ensuring each visitor is identified and logged. Even though each team member may be required to authenticate, exemplary embodiments may only send a single notification 38 for the entire team.

Figure 15:
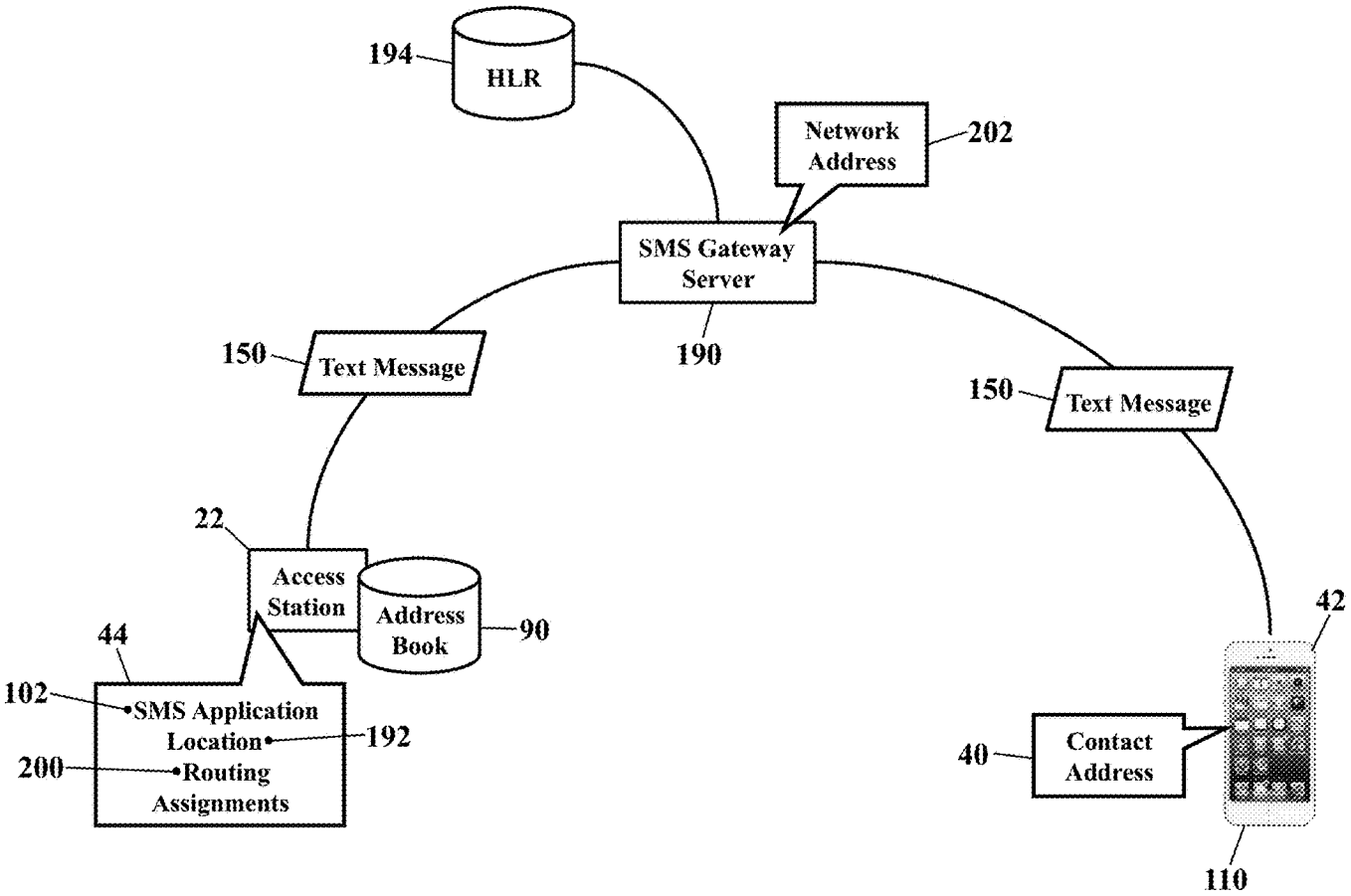
FIGS. 15-16 are more detailed schematics illustrating text messaging notifications, according to exemplary embodiments.
Figure 16:
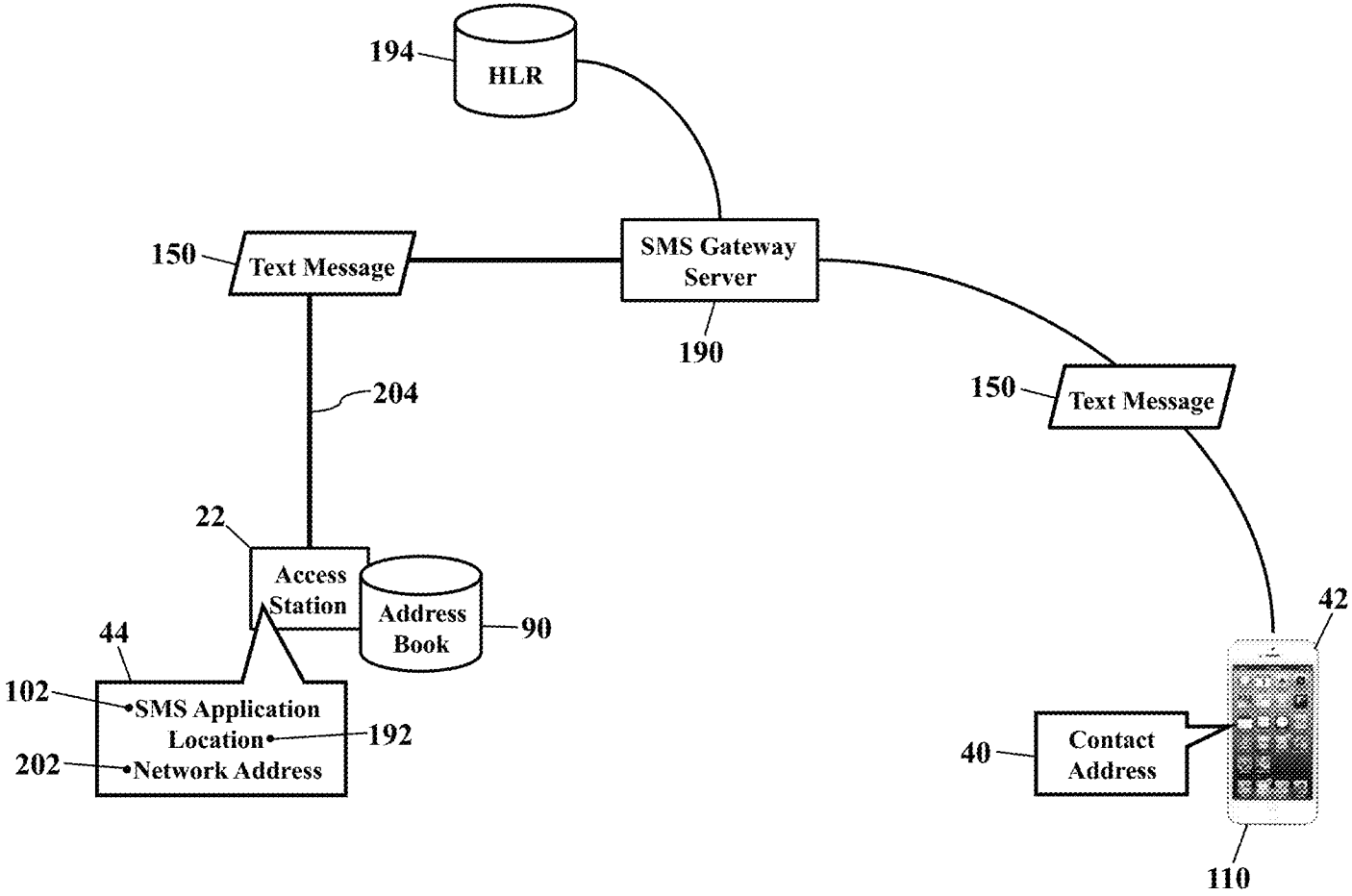

FIGS. 15-16 are more detailed schematics illustrating text messaging notifications, according to exemplary embodiments. As this disclosure explains, the access station 22 may send the text message 150 to notify the host of the visitor's arrival. Here, though, network routings may be defined to reduce delay and traffic in the communications network 26. The access station 22, for example, may have a dedicated SMS gateway server 190 for sending text messages. Because the access station 22 is preferably located within a lobby of a facility or building, exemplary embodiments may assume that all the host employees are also physically present within the same facility or building. That is, the employees and the access station 22 are physically located within the same building or facility grounds. The access station 22 and the employees may be assumed to have the same, or nearly the same, local geographic location 192.

Conventional text messaging uses a home location register ("HLR") 194. In a conventional mobile or cellular network, the text message 150 from the access station 22 is routed to a short message center (or "SMC") server and stored. The short message center server then queries the home location register 194 for a current location of the recipient device. The home location register 194 responds with the mobile switching center ("MSC") currently serving the recipient device. Now that the correct mobile switching center is known, the short message center server forwards text messages to the network address of the correct mobile switching center. The mobile switching center then selects the corresponding base station that currently serves the recipient device. The mobile switching center thus forwards text messages to the corresponding base station for transmission to the recipient device.

Exemplary embodiments, however, may bypass the home location register 194. When the employees are assumed to be nearly co-located with the access station 22, there is really no need to utilize the locational architecture of a conventional network. Exemplary embodiments may assume the host employee is located in the same vicinity as the access station 22. The access station 22, then, need not waste time in trying to locate the recipient of the text message 150. The access station 22, instead, may simply route the text message 150 directly to the SMS gateway server 190 that services the geographic location 192 of the access station 22.

FIG. 15 illustrates routing assignments 200. When the access station 22 needs to notify the host's contact address 40 with the text message 150, the access station 22 may consult the routing assignments 200. FIG. 15 illustrates the routing assignments 200 being locally stored within the access station 22, but the routing assignments 200 may be remotely accessed and retrieved. Regardless, the routing assignments 200 may associate the host's contact address 40 to the network address 202 assigned to the local SMS gateway server 190. Whenever the access station 22 sends the notification text message 150 to the host's contact address 40, the access station 22 defaults to the dedicated local SMS gateway server 190 assigned to the same geographic location 192. The local SMS gateway server 190, in other words, is dedicated to all text messages initiated by the access station 22. All the employee's contact addresses (in the address book 90) may thus be associated to the same, single network address 202 assigned to the local SMS gateway server 190. The assumed co-location 192 between the access station 22 and the host's contact address 40 allows exemplary embodiments to by-pass the home location register 194. The routing assignments 200 may thus force all text messages to the one local SMS gateway server 190 for transmission.

FIG. 16 illustrates physical dedication. Here the access station 22 may physically interface with the dedicated SMS gateway server 190. A physical link 204 (such as a line or cable) may connect between an input/output of the access station 22 and an input/output of the dedicated SMS gateway server 190. No routing assignments may thus be needed, as the access station is hardwired to the dedicated SMS gateway server 190. When the access station 22 needs to notify the host's contact address 40 with the text message 150, the text message 150 may travel along the dedicated link 204 to the SMS gateway server 190 for transmission.

Figure 17:
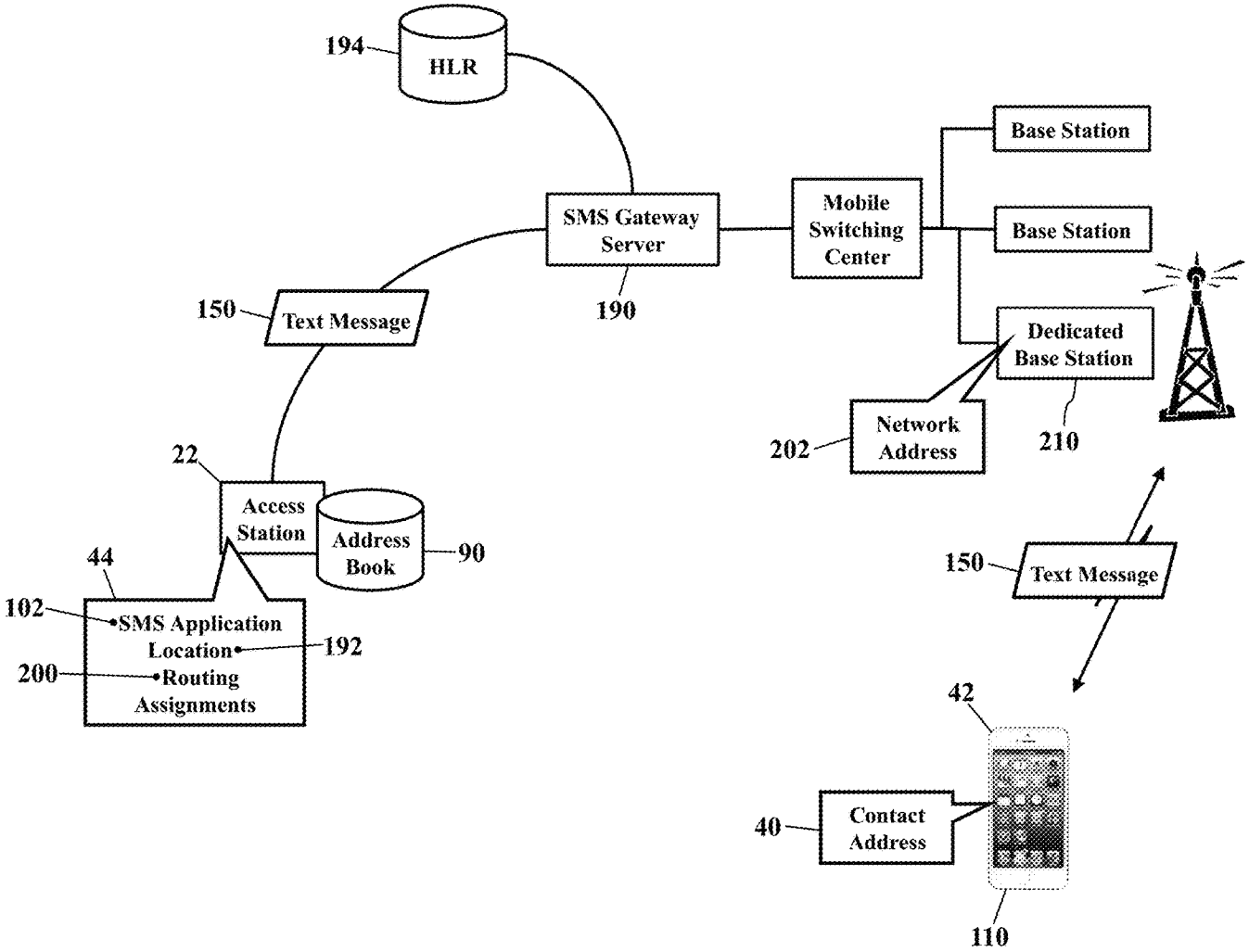
FIGS. 17-19 are schematics illustrating dedicated architecture, according to exemplary embodiments.

FIG. 17 is a schematic illustrating a dedicated base station 210, according to exemplary embodiments. Even though the access station 22 may have the dedicated SMS gateway server 190, the SMS gateway server 190 may serve multiple base stations. If the host's contact address 40 is assumed to share the same transmission cell, then exemplary embodiments may implement further simplifications. Here, then, the access station 22 may even have one of the base stations dedicated to transmission of its notification. The routing assignments 200 may further force the text message 150 to be wirelessly transmitted from the dedicated base station 210. So, not only is text messaging dedicated to the local SMS gateway server 190, but one of its base stations may also dedicated to transmissions associated with the access station 22. All the employee's contact addresses (in the address book 90) may thus be associated to the same, single network address 202 assigned to the dedicated base station 210, still further by-passing the home location register 194.

Figure 18:
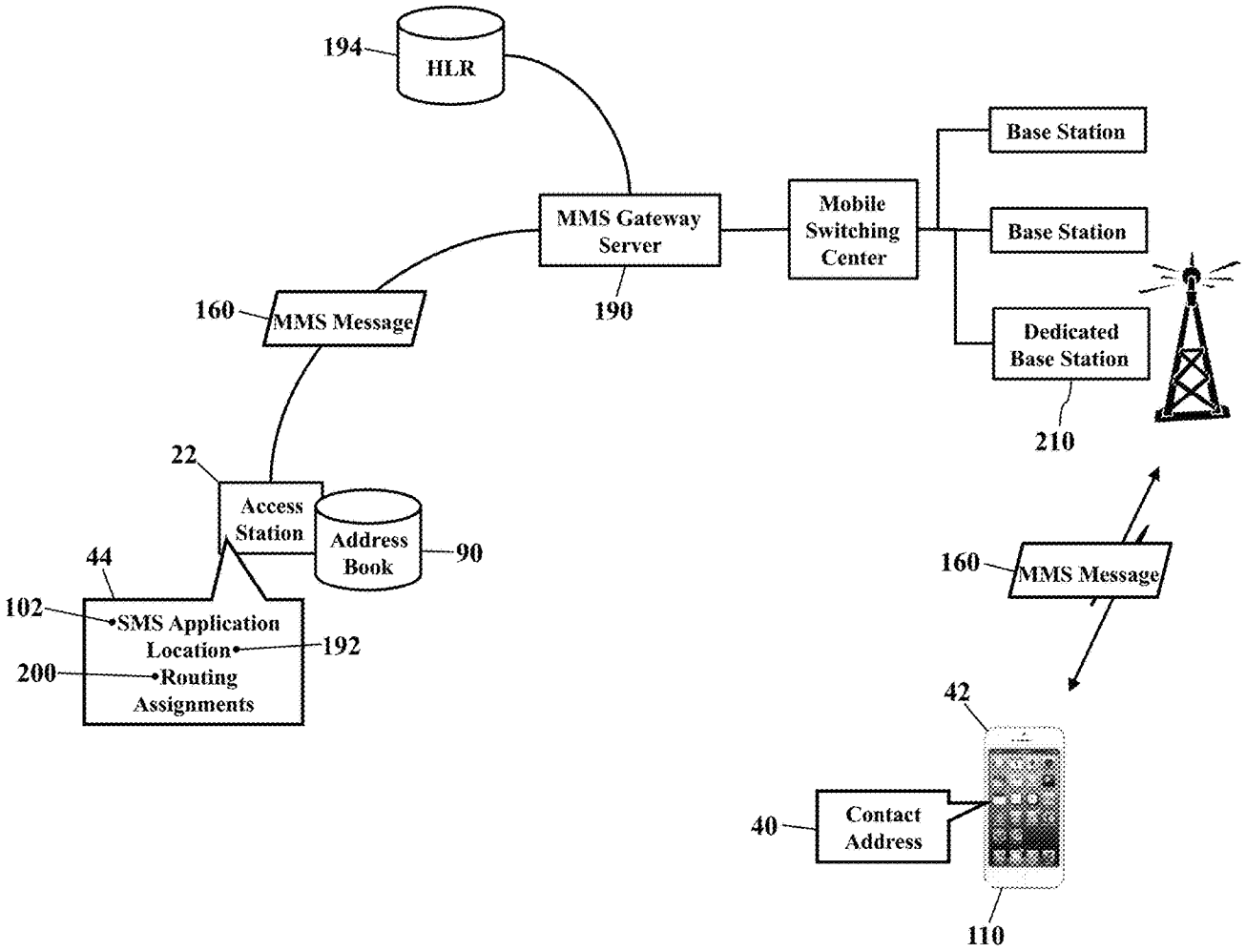
Figure 19:
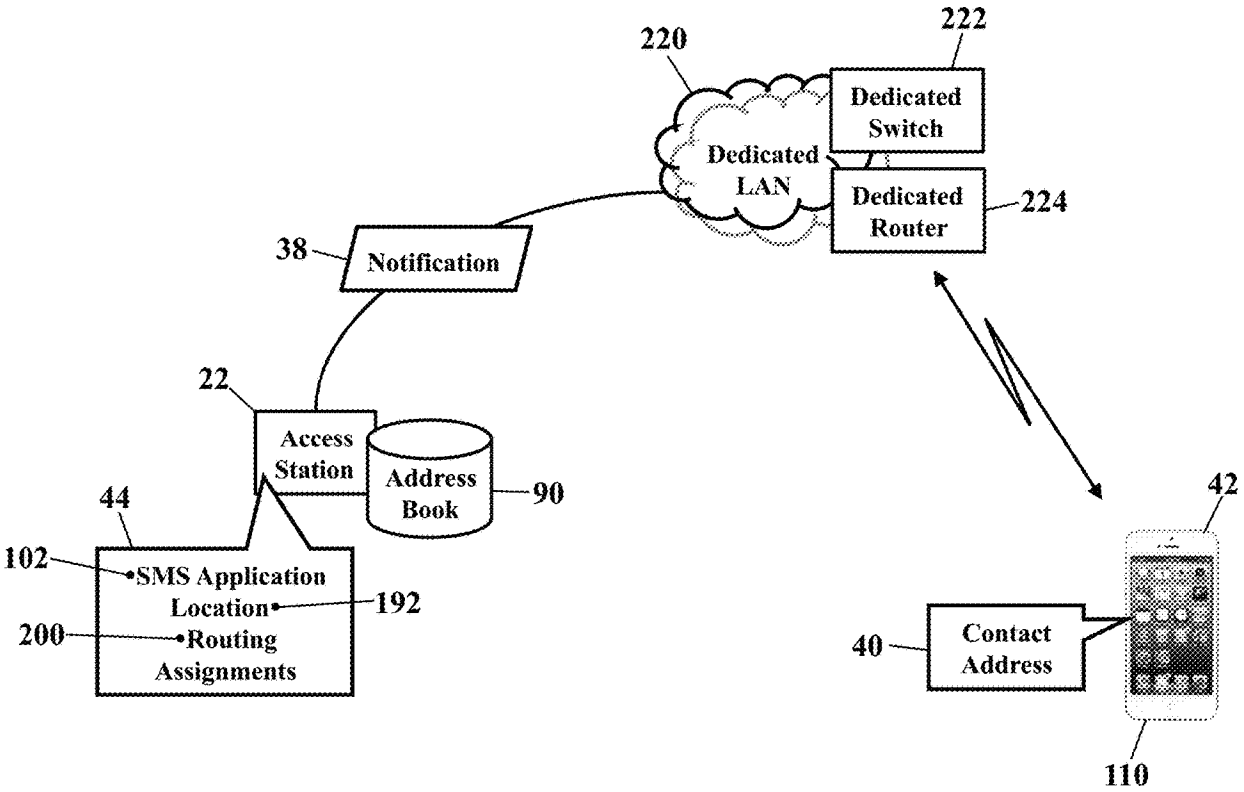

FIGS. 18-19 are more schematics illustrating dedicated architecture, according to exemplary embodiments. FIG. 18 illustrates dedicated infrastructure when transmitting the multi-media system ("MMS") message 160. When the access station 22 sends the multi-media system message 160 to the contact address 40, the routing assignments 200 may force the multi-media system message 160 to a dedicated MMS gateway server 212. The routing assignments 200 may even specify the dedicated base station 210 that wirelessly transmits the multi-media system message 160. The dedicated architecture permits exemplary embodiments to by-pass the home location register 194, as above explained. Time and network traffic are reduced.

FIG. 19 illustrates even more dedicated notification componentry. Here the locational assumptions may be applied to any networking configuration. Exemplary embodiments implement much efficiency when the host's contact address 40 is assumed to generally share the same geographic location 192 as the access station 22. These efficiencies may be applied to any networking component, standard, or technology. FIG. 19, for example, illustrates a dedicated local area network 220 (such as a WI-FI® or BLUETOOTH®) that is used for the notification 38. Whatever the form or formatting of the notification 38, the access station 22 may specify delivery of the notification 38 over dedicated local area network 220. The routing assignments 200 may even further specify a dedicated switch 222 and/or a dedicated router 224 serving the local area network 220. The address book 90 may further store these associations between each employee's contact address 40 and the network address(es) of the dedicated architecture.

Figure 20:
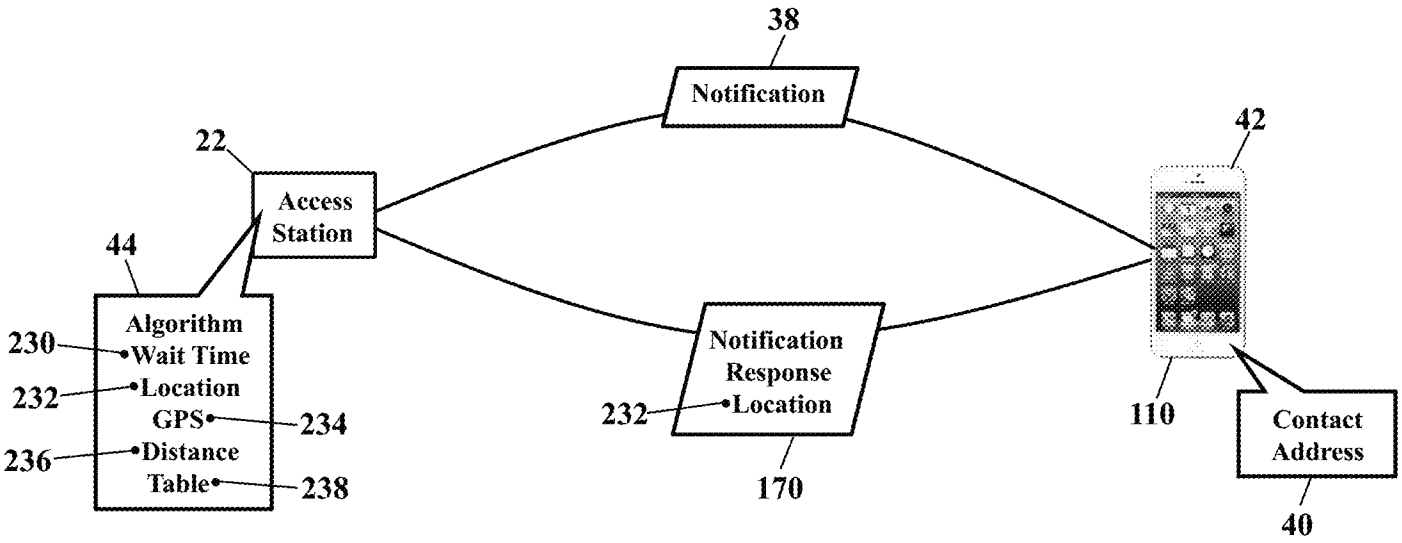
FIGS. 20-21 are schematics illustrating wait times, according to exemplary embodiments.
Figure 21:
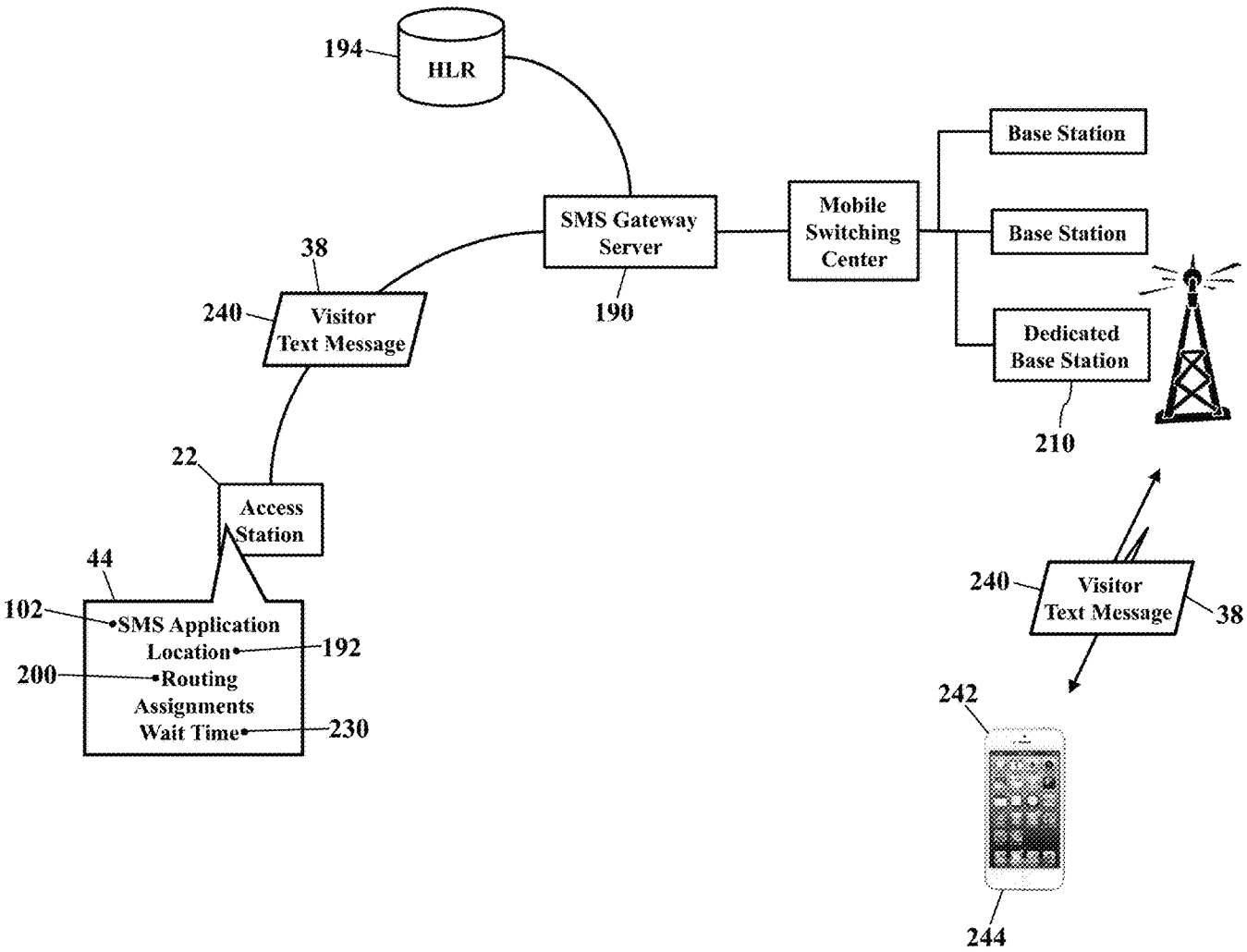

FIGS. 20-21 are schematics illustrating wait times, according to exemplary embodiments. Once the visitor successfully authenticates to the access station 22, the access station 22 notifies the contact address 40 associated with the employee host (as the above paragraphs explained). Exemplary embodiments may then determine an amount of wait time 230 that the visitor must wait until arrival of the host. Exemplary embodiments, for example, may estimate the wait time 230 based on the physical location 232 of the host's mobile device (such as the host's smartphone 110). When the access station 22 initiates the notification 38, for example, the notification 38 may include a command or parameter that requests the current physical location 232 of the host's device 42. There are many methods for determining the physical location 232, so no detailed explanation is needed. Most simple and prevalent, however, may be global positioning system ("GPS") signals. Many devices have global positioning system ("GPS") capabilities. The host's smartphone 110, for example, may include or report its GPS coordinates 234 when sending the notification response 170. The access station 22 may thus use the GPS coordinates 234 to estimate a distance 236 to the access station 22. The distance 236 may be a straight, linear line estimation between locational coordinates. The distance 236, however, may be more detailed and determined using a map of the building or facility. Distances and walking times may be computed based on an average pace. Most simply, however, may be a database table 238 that stores different wait times associated with different GPS coordinates 234. Different ranges of the GPS coordinates 234 may be associated with different areas or floors within a building. Even particular rooms or machines may be associated with smaller ranges of the GPS coordinates 234. Regardless, once the GPS coordinates 234 are known, the access station 22 may query the database table 238 for the GPS coordinates 234 reported by the host's smartphone 110. When a matching entry is found, the access station 22 retrieves the corresponding wait time 230. The access station 22 may then process the wait time 230 for display. The visitor is thus informed of the wait time 230 before her escort arrives.

As FIG. 21 illustrates, the estimated wait time 230 may be reported to the visitor's mobile device 242. Once the wait time 230 is retrieved, the access station 22 may generate a visitor text message 240 for delivery to the visitor's mobile device 242 (such as the visitor's smartphone 244). The visitor text message 240 is routed to the network address assigned to the visitor's mobile device 242, which may have been obtained from registration or from a visitor profile. As the visitor's mobile device 242 is again co-located with the access station 22, the visitor's mobile device 242 defaults to the dedicated architecture (as above explained). For example, the routing assignments 200 may specify that the visitor text message 240 routes to the dedicated SMS gateway server 190 and/or the dedicated base station 210, as earlier explained. Again, then, exemplary embodiments may by-pass the home location register 194 to avoid unnecessary delay and traffic.

Figure 22:
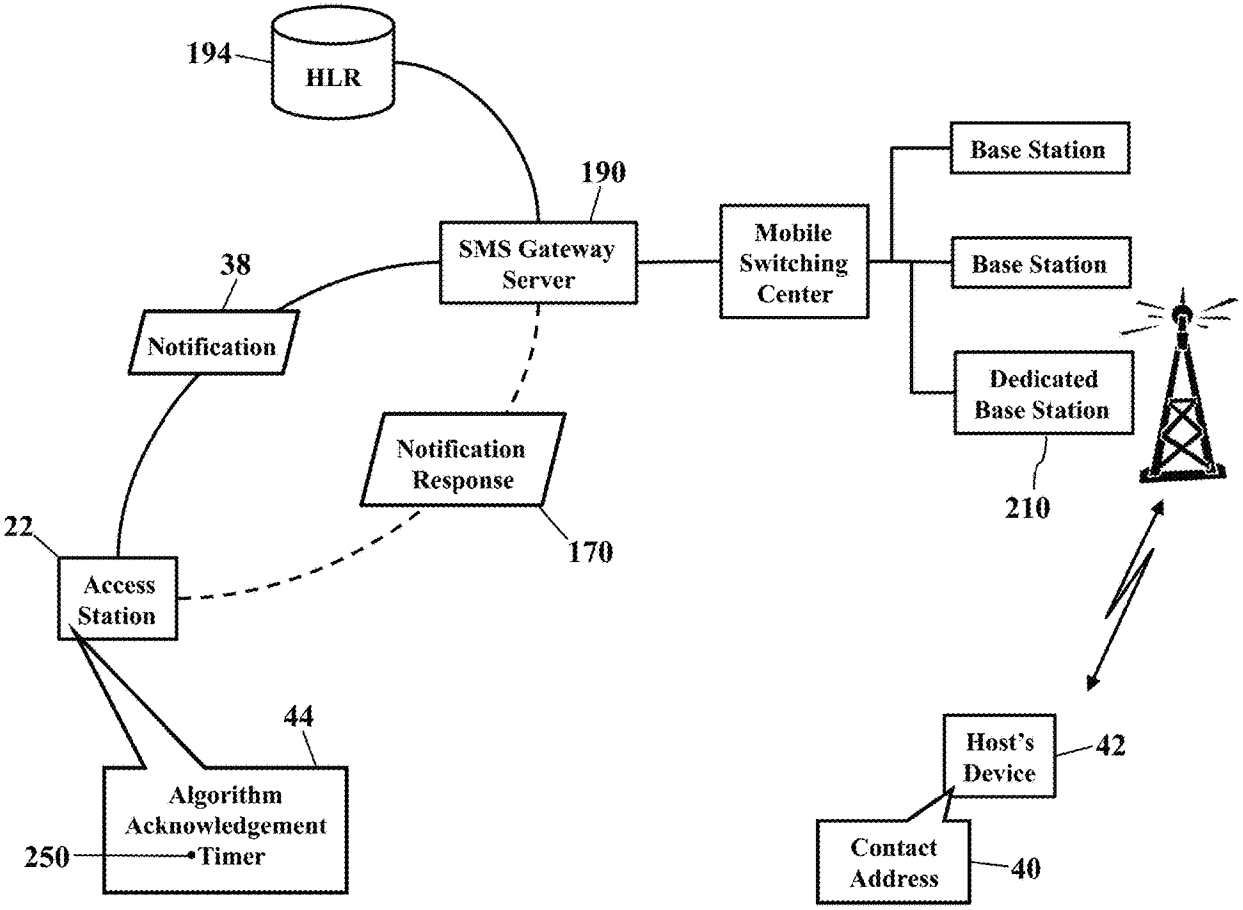
FIG. 22 is a schematic illustrating locational considerations, according to exemplary embodiments.

FIG. 22 is a schematic illustrating locational considerations, according to exemplary embodiments. Exemplary embodiments send the notification 38 to alert the host of the visitor's arrival. When the access station 22 receives the notification response 170, then the notification 38 was successfully received at the contact address 40 (as illustrated with reference to FIG. 12).

Sometimes, however, the notification 38 fails. That is, the access station 22 may fail to receive the notification response 170. The access station 22, for example, may execute an acknowledgement timer 250 that counts up or down to a final value. While the acknowledgement timer 250 counts to its final value, the access station 22 monitors for receipt of the notification response 170. If the acknowledgement timer 250 expires without receipt of the notification response 170, the access station 22 may reinitiate or resend the notification 38. If receipt continues to fail, the access station 22 may execute rules or programming that invokes the home location register ("HLR") 194. That is, upon failure to receive the notification response 170 from the contact address 40 using dedicated infrastructure, exemplary embodiments may revert to using the home location register 194 to locate the host recipient at the contact address 40.

Figure 23:
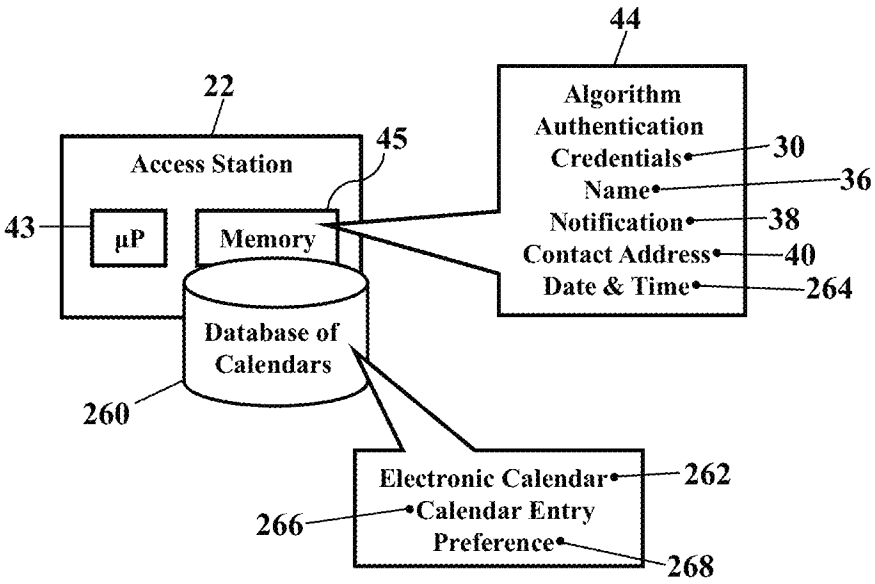
FIG. 23 is a schematic illustrating unexpected contact requests, according to exemplary embodiments.

FIG. 23 is a schematic illustrating unexpected contact requests, according to exemplary embodiments. As the reader may know, sometimes a visitor may unexpectedly arrive and wish to contact an employee/host. Exemplary embodiments may then autonomously determine whether to notify the host. When the visitor authenticates and selects the name 36 of the host (as illustrated with reference to FIGS. 1 & 5-6), the access station 22 may query a database 260 of electronic calendars. The database 260 of electronic calendars maps or relates different names and/or different contact addresses to their corresponding electronic calendar 262. The access station 22 retrieves a filename, location, and/or uniform resource locator associated with the corresponding electronic calendar 262. The access station 22 then queries the corresponding electronic calendar 262 for the current date and time 264. The access station 22 thus retrieves any information describing a calendar entry 266 associated with the current date and time 264. A null value, for example, may indicate the name 36 or the contact address 40 is available, so the access station 22 may approve or authorize sending the notification 38. The mere existence of the calendar entry 266, though, may indicate the name 36 or the contact address 40 is unavailable. The access station 22 may thus decline to initiate the notification 38. Indeed, the database 260 of electronic calendars may further store or associate a notification preference 268 for each employee, indicating the employee's preference for the notification 38. Some employees may always want the notification 38 of the visitor, regardless of the calendar entry 266. Other employees, however, may reject all notifications when calendar conflicts exist.

Figure 24:
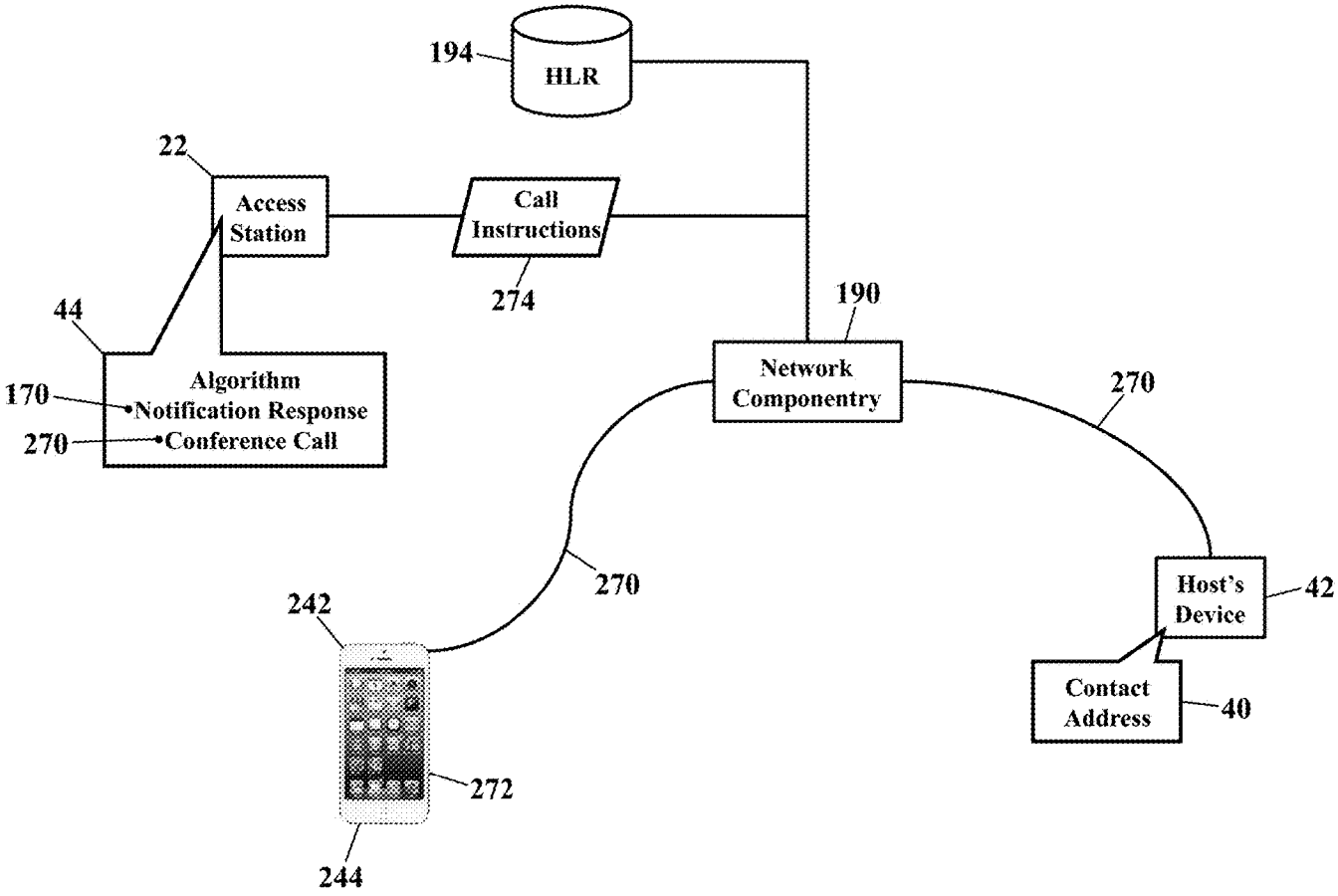
FIG. 24 is a schematic illustrating a conference call, according to exemplary embodiments.

FIG. 24 is a schematic illustrating a conference call 270, according to exemplary embodiments. If the access station 22 needs to utilize the home location register 194 (as above explained), the employee may not be locally located. The access station 22 thus uses the home location register 194 to locate the host associated with the contact address 40. Conventional architecture may thus be used to locate and to notify the host at the contact address 40.

The host may approve the conference call 270. Once the host's device 42 is notified (using the home location register 194), the host may approve or request the conference call 270 with the visitor. When the hosts' device 42 (at the contact address 40) sends the notification response 170, the notification response 170 may include a permission parameter for the conference call 270. The permission parameter permits or instructs the access station 22 to initiate or broker the conference call 270 between the visitor and the host. The access station 22 may thus retrieve the visitor's contact address 272 associated with the visitor's mobile device 242 (such as the visitor's smartphone 244). The visitor's contact address 272 may be required when the visitor registers with the access station 22, or the visitor's contact address 272 may be retrieved from a profile associated with the visitor. Once the visitor's contact address 272 is known, the access station 22 may generate call instructions 274 (perhaps using the call application 108 illustrated in FIG. 5) to establish a telephony call, or a voice-over Internet call, between the host's contact address 40 and the visitor's contact address 272 (e.g., telephone number or IP address). The access station 22 thus automatically and autonomously initiates the conference call 270, allowing the host and the visitor to converse.

Figure 25:
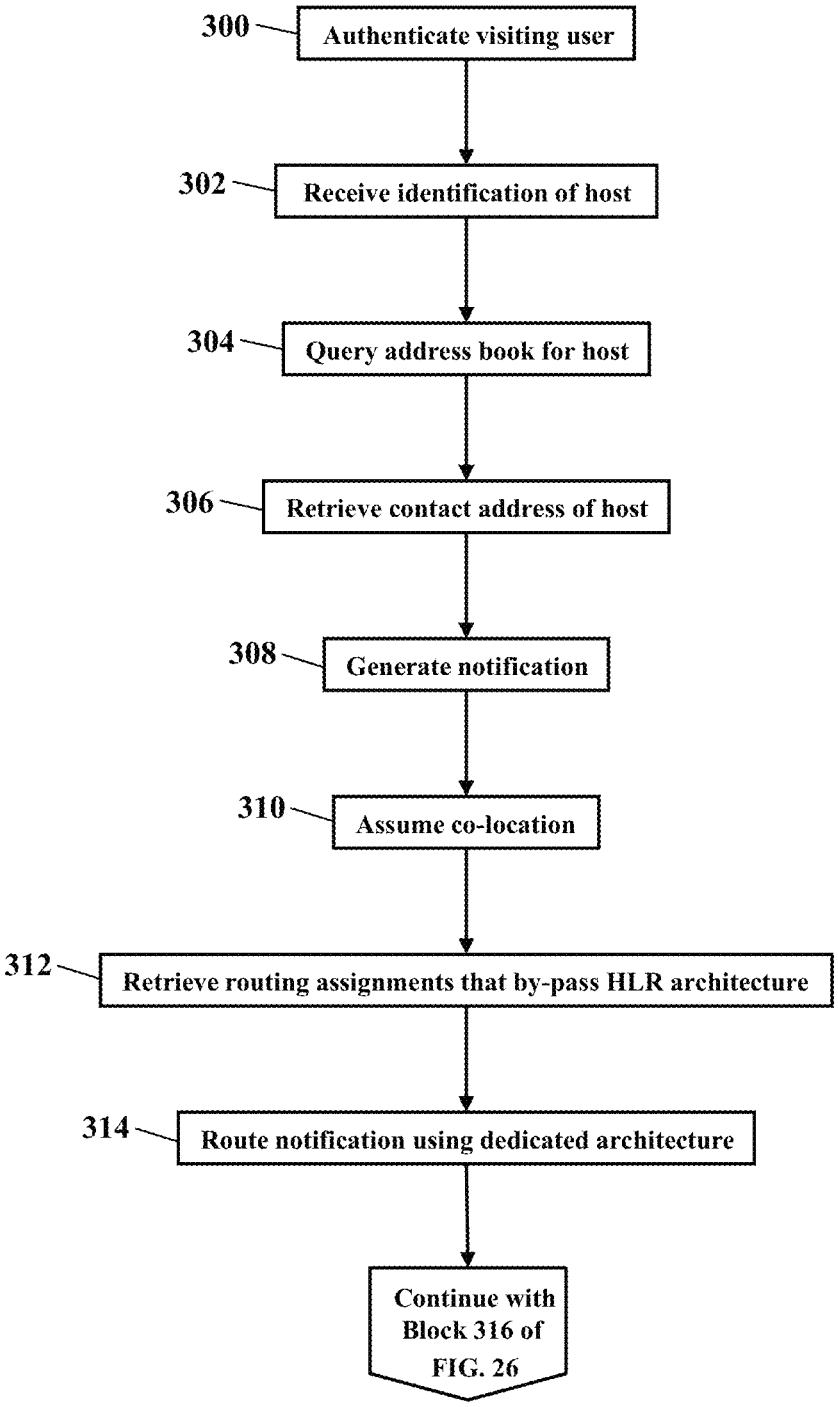
FIGS. 25-26 are flowcharts illustrating a method for notifying a host, according to exemplary embodiments.
Figure 26:
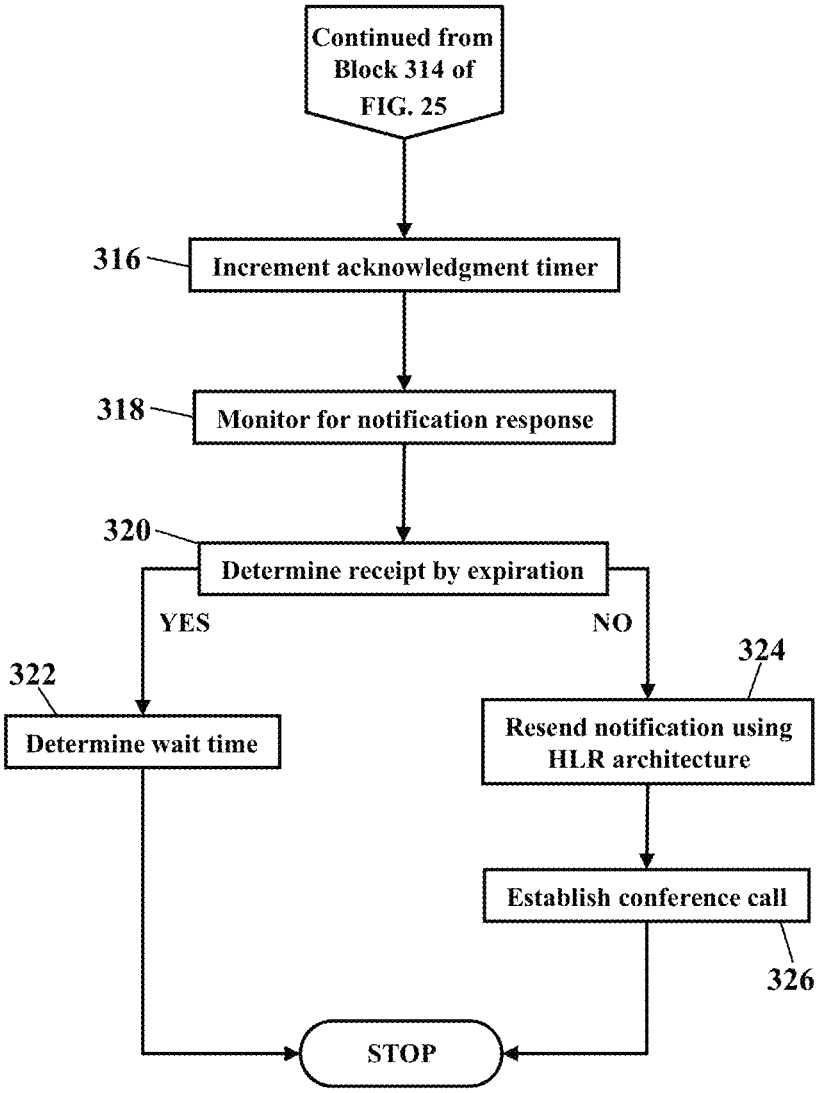

FIGS. 25-26 are flowcharts illustrating a method of the algorithm 44 for notifying the host, according to exemplary embodiments. The visiting user authenticates to the access station 22 (Block 300). The visiting user identifies the desired host, such as by inputting the name 36 (Block 302). The address book 90 is queried for the host (Block 304), and the associated contact address 40 is retrieved (Block 306). The notification 38 is generated (Block 308) and co-location is assumed (Block 310). The routing assignments 200 are retrieved to by-pass home location register architecture (Block 312). The notification 38 is routed to the contact address 40 using dedicated architecture, as specified by the routing assignments 200 (Block 314).

The flowchart continues with FIG. 26. The acknowledgment timer 250 increments (Block 316) while monitoring for receipt of the notification response 170 (Block 318). If the notification response 170 is received prior to expiration (Block 320), the wait time 230 is determined (Block 322). If the notification response 170 is not received by expiration (Block 320), the notification 38 is resent using home location register architecture (Block 324). The conference call 270 may be established between the desired host and the visiting user (Block 326).

Figure 27:
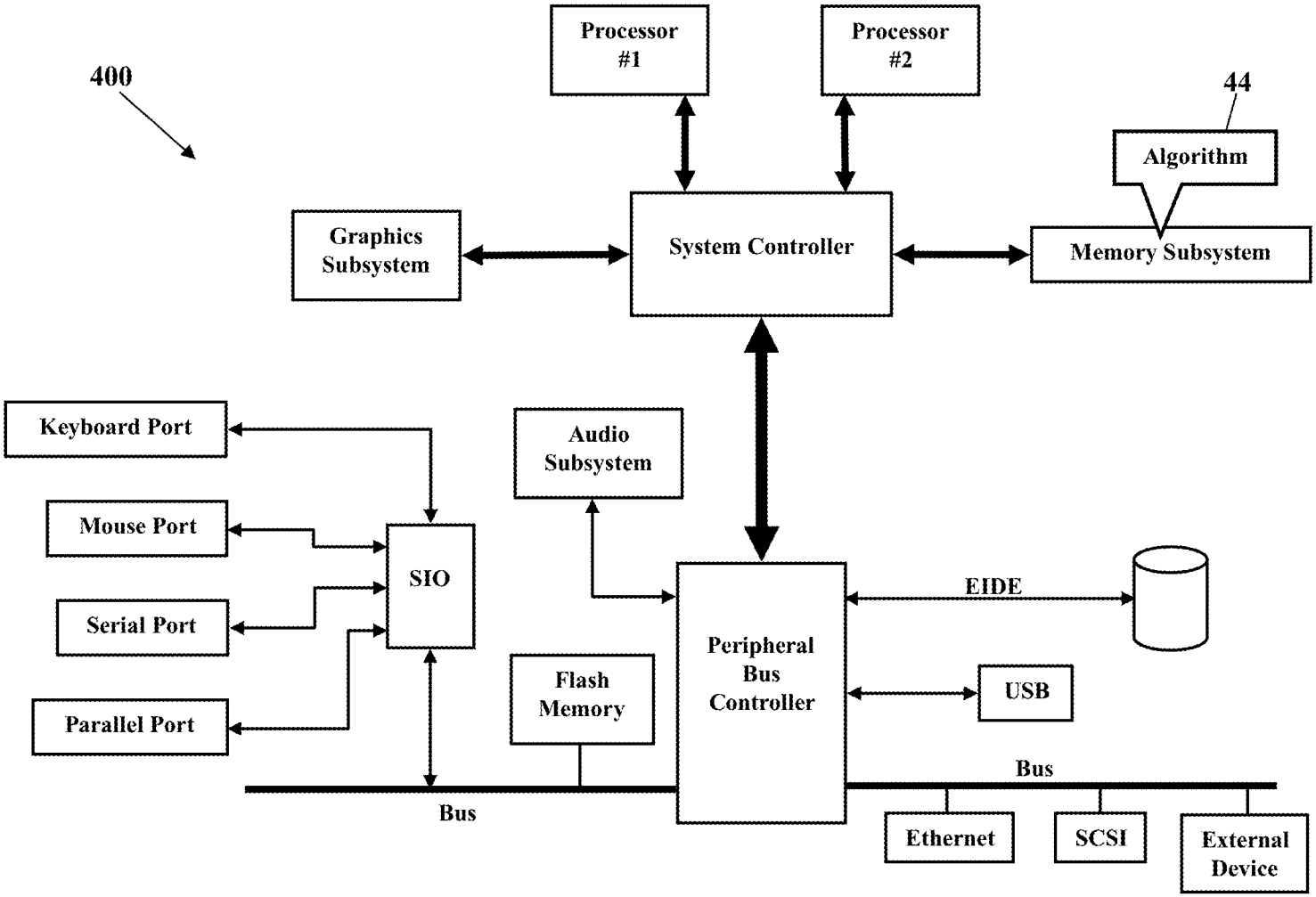
FIGS. 27-28 depict still more operating environments for additional aspects of the exemplary embodiments.

FIG. 27 is a schematic illustrating still more exemplary embodiments. FIG. 27 is a more detailed diagram illustrating a processor-controlled device 400. As earlier paragraphs explained, the algorithm 44 may operate in any processor-controlled device. FIG. 27, then, illustrates the algorithm 44 stored in a memory subsystem of the processor-controlled device 400. One or more processors communicate with the memory subsystem and execute either, some, or all applications. Because the processor-controlled device 400 is well known to those of ordinary skill in the art, no further explanation is needed.

Figure 28:
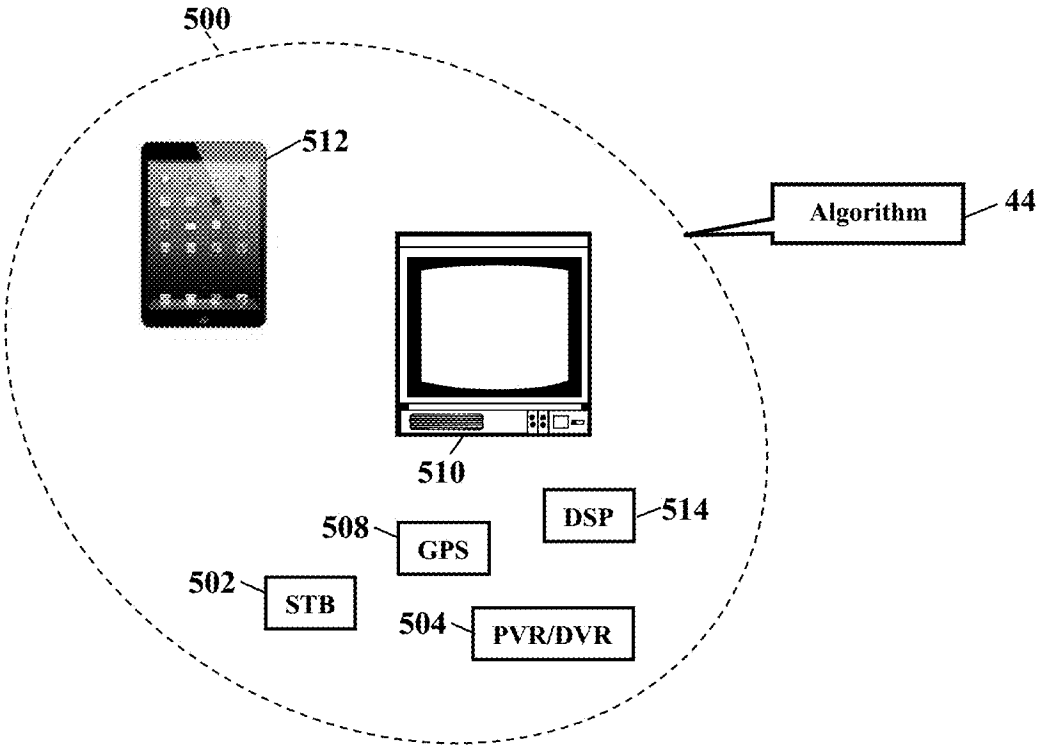

FIG. 28 depicts other possible operating environments for additional aspects of the exemplary embodiments. FIG. 28 illustrates the algorithm 44 operating within various other devices 500. FIG. 28, for example, illustrates that the algorithm 44 may entirely or partially operate within a set-top box ("STB") (502), a personal/digital video recorder (PVR/DVR) 504, a Global Positioning System (GPS) device 508, an interactive television 510, a tablet computer 512, or any computer system, communications device, or processor-controlled device utilizing the processor 43 and/or a digital signal processor (DP/DSP) 514. The device 500 may also include watches, radios, vehicle electronics, clocks, printers, gateways, mobile/implantable medical devices, and other apparatuses and systems. Because the architecture and operating principles of the various devices 500 are well known, the hardware and software componentry of the various devices 500 are not further shown and described.

Exemplary embodiments may be physically embodied on or in a computer-readable storage medium. This computer-readable medium, for example, may include CD-ROM, DVD, tape, cassette, floppy disk, optical disk, memory card, memory drive, and large-capacity disks. This computer-readable medium, or media, could be distributed to end-subscribers, licensees, and assignees. A computer program product comprises processor-executable instructions for controlled access, as the above paragraphs explained.

While the exemplary embodiments have been described with respect to various features, aspects, and embodiments, those skilled and unskilled in the art will recognize the exemplary embodiments are not so limited. Other variations, modifications, and alternative embodiments may be made without departing from the spirit and scope of the exemplary embodiments.

The invention claimed is:

1. A method, comprising:

authenticating, by an access control system, an identity associated with a user;

receiving, by the access control system, a contact request requesting a contact with a name associated with a host;

querying, by the access control system, an electronic database for the name associated with the host, the electronic database electronically associating contact addresses and names including the name associated with the host;

identifying, by the access control system, a contact address of the contact addresses from the electronic database that is electronically associated with the name associated with the host;

identifying, by the access control system, a geographic location associated with the contact address that is electronically associated with the name associated with the host;

querying, by the access control system, a database table for the geographic location associated with the contact address, the database table electronically associating wait times to locations including the geographic location associated with the contact address;

identifying, by the access control system, a wait time of the wait times specified by the database table that is electronically associated with the geographic location; and initiating, by the access control system, an automated short messaging service text message to the user, the automated short messaging service text message informing the user of the wait time prior to an arrival of the host.

2. The method of claim 1, further comprising sending the automated short messaging service text message via a dedicated physical cable connecting the access control system to a dedicated gateway.

3. The method of claim 1, further comprising:

assuming the host and the access control system share a transmission cell within a cellular network; and sending the automated short messaging service text message via a dedicated base station for a transmission in the transmission cell.

4. The method of claim 1, further comprising receiving an acknowledgment to the automated short messaging service text message.

5. The method of claim 1, further comprising initiating a call to the contact address.

6. The method of claim 1, further comprising authenticating the host to the access control system.

7. The method of claim 1, further comprising biometrically authenticating the user to the access control system.

8. A system, comprising:

a hardware processor; and a memory device, the memory device storing instructions, the instructions when executed causing the hardware processor to perform operations, the operations comprising:

authenticating an identity associated with a user to an access control system;

receiving a contact request at the access control system, the contact request entered by the user and requesting contact with a name associated with a host;

querying an electronic database for the name associated with the host, the electronic database electronically associating contact addresses and names including the name associated with the host;

identifying a contact address of the contact addresses specified by the electronic database that is electronically associated with the name associated with the host;

determining global positioning system information associated with the contact address that is electronically associated with the name associated with the host;

querying a database table for the global positioning system information associated with the contact address, the database table electronically associating wait times to locations including the geographic location associated with the contact address;

identifying a wait time of the wait times specified by the database table that is electronically associated with the global positioning system information; and initiating an automated short messaging service text message to the user, the automated short messaging service text message informing the user of the wait time prior to an arrival of the host.

9. The system of claim 8, wherein the operations further comprise querying routing assignments for the contact address electronically associated with the name associated with the host, the routing assignments electronically associating the contact addresses to gateway addresses.

10. The system of claim 9, wherein the operations further comprise identifying a gateway address of the gateway addresses specified by the routing assignments that is electronically associated with the contact address.

11. The system of claim 10, wherein the operations further comprise estimating the arrival of the host based on the wait time.

12. The system of claim 8, wherein the operations further comprise initiating a call to the contact address.

13. The system of claim 8, wherein the operations further comprise authenticating the host to the access control system.

14. The system of claim 8, wherein the operations further comprise biometrically authenticating the user to the access control system.

15. A non-transitory memory device storing instructions that when executed cause a hardware processor to perform operations, the operations comprising:

authenticating an identity associated with a user to an access control system;

receiving a contact request at the access control system, the contact request entered by the user and requesting contact with a name associated with a host;

querying an electronic database for the name associated with the host, the electronic database electronically associating contact addresses and names including the name associated with the host;

determining global positioning system information associated with the contact address that is electronically associated with the name associated with the host;

querying a database table for the global positioning system information associated with the contact address, the database table electronically associating wait times to locations including the geographic location associated with the contact address;

identifying a wait time of the wait times specified by the database table that is electronically associated with the global positioning system information; and initiating an automated short messaging service text message to the user, the automated short messaging service text message informing the user of the wait time prior to an arrival of the host.

16. The non-transitory memory device of claim 15, wherein the operations further comprise initiating a call to the contact address.

17. The non-transitory memory device of claim 15, wherein the operations further comprise authenticating the host to the access control system.

* * * * *